US007179572B2

(12) United States Patent
Ohno et al.

(10) Patent No.: US 7,179,572 B2
(45) Date of Patent: Feb. 20, 2007

(54) FLUORESCENT SCREEN FORMING METHOD, FLUORESCENT SCREEN FORMING APPARATUS AND CATHODE-RAY TUBE

(75) Inventors: Katsutoshi Ohno, Tokyo (JP); Koji Fujita, Kanagawa (JP)

(73) Assignee: Sony Corporation (JP)

( * ) Notice: Subject to any disclaimer, the term of this patent is extended or adjusted under 35 U.S.C. 154(b) by 597 days.

(21) Appl. No.: 10/479,156

(22) PCT Filed: May 31, 2002

(86) PCT No.: PCT/JP02/05391

§ 371 (c)(1),
(2), (4) Date: Dec. 1, 2003

(87) PCT Pub. No.: WO02/099831

PCT Pub. Date: Dec. 12, 2002

(65) Prior Publication Data

US 2004/0156981 A1 Aug. 12, 2004

(30) Foreign Application Priority Data

Jun. 1, 2001 (JP) ..... 2001-167222
Jun. 15, 2001 (JP) ..... 2001-182268
Jun. 15, 2001 (JP) ..... 2001-182269

(51) Int. Cl.
*B05C 1/02* (2006.01)
*H01J 9/20* (2006.01)

(52) U.S. Cl. ..... 430/23; 430/26; 427/64; 427/68; 427/157; 156/391; 156/443; 156/459; 156/468

(58) Field of Classification Search ..... None
See application file for complete search history.

(56) References Cited

U.S. PATENT DOCUMENTS 5,418,075 A * 5/1995 Utsumi ..... 428/690

(Continued)

FOREIGN PATENT DOCUMENTS

JP 5-234508 A 9/1993

(Continued)

OTHER PUBLICATIONS

English language abstracts and computer-generated translation of JP 8-055578, Feb. 1996.*

(Continued)

*Primary Examiner*—John A. McPherson
(74) *Attorney, Agent, or Firm*—Rader Fishman & Grauer; Ronald P. Kananen

(57) ABSTRACT

The present invention relates to a fluorescent screen forming method, a fluorescent screen forming apparatus and a cathode-ray tube. In the fluorescent screen forming method according to the present invention, a transfer roller lowers a transfer sheet to somewhere above the inner surface of the panel and the transfer roller moves up to the end edge positions of the inner surface of the panel, whereafter the transfer roller moves downwards onto the end edges of the inner surface of the panel in unison with the transfer film to start pressing the transfer film. Therefore, the transfer roller can reach the end edges of the panel, and hence component layers of a fluorescent screen can be transferred up to the end edges of the inner surface of the panel. A fluorescent screen forming apparatus according to the present invention includes a transfer film supply means, a transfer roller, and a control means, wherein operations of the above-mentioned transfer method are executed. As a result, it becomes possible to form a highly-reliable fluorescent screen. Further, a cathode-ray tube according to the present invention includes the fluorescent screen that has been formed by using the above-described transfer method. Thus, it is possible to provide a high-reliable cathode-ray tube of which the effective screen is large. Furthermore, when cathode-ray tubes are manufactured by using the above-described transfer method, the cathode-ray tubes can be produced more inexpensively.

5 Claims, 17 Drawing Sheets

U.S. PATENT DOCUMENTS

2002/0024287 A1* 2/2002 Miura et al. ..... 313/422

FOREIGN PATENT DOCUMENTS

JP 8-55578 A 2/1996
JP 2001-079467 A * 3/2006

OTHER PUBLICATIONS

International Search Report dated Sep. 17, 2002.

* cited by examiner

FLUORESCENT SCREEN FORMING METHOD, FLUORESCENT SCREEN FORMING APPARATUS AND CATHODE-RAY TUBE

TECHNICAL FIELD

The present invention relates to a fluorescent screen forming method in which an effective display area can be enlarged, a reliability thereof can be improved, a work efficiency thereof can be increased and a cost thereof can be decreased and a fluorescent screen forming apparatus thereof.

The present invention relates to a cathode-ray tube in which an effective display area can be enlarged, a reliability can be improved and a cost thereof can be decreased.

BACKGROUND ART

It has been customary to use a slurry method to form fluorescent screens of cathode-ray tubes for television receivers, display devices for use with computers and the like. A fluorescent screen of a color cathode-ray tube, for example, is formed as follows.

First, a photosensitive painted film is formed on a panel of a cathode-ray tube, i.e. the inner surface of a panel having a skirt portion extended over the whole of the peripheral edge portion. Photosensitive painted films such as PVA (polyvinyl alcohol)—ADC (ammonium dichromate) based photosensitive painted films or PVA (polyvinyl pyrrolidone)—DAS (4,4'-diazitostilbene 2,2'-disulfuric acid ammonium) based photosensitive painted films are available as the above photosensitive painted film. After the photosensitive painted film has been dried, the dried photosensitive painted film is exposed with irradiation of ultraviolet rays by using a color selection structure as an optical mask and developed by a suitable method such as rinsing by water, thereby resulting in stripe-like resist layers, for example, being formed at the positions corresponding to respective colors.

Next, after a carbon slurry has been coated on the whole surface including the resist layers and dried, the resultant product is treated by a reversal process, the carbon layer on the resist layers is removed by a lift off method in unison with the resist layers and thereby carbon stripes (CS) with predetermined patterns are formed.

Next, a fluorescent substance slurry of a first color, e.g. blue is coated on the carbon stripes. After the thus coated fluorescent substance slurry has been dried, the resultant product is exposed with irradiation of ultraviolet rays by using the color selection structure as the optical mask and then developed to form a blue fluorescent substance stripe between predetermined carbon stripes. In a like manner, a green fluorescent substance stripe and a red fluorescent substance strip are formed between other carbon stripes (CS) and thereby a desired color fluorescent screen is formed.

According to the above-mentioned slurry method, when the resist layer is processed, the panel of the cathode-ray tube has to be rotated. At that time, not only electric power is required but also a large amount of surplus resist stripper is scattered around the panel. As a result, treatment of the resist stripper that has been scattered around the panel and waste disposal of the surplus resist stripper need a large amount of cost and much time and labor. Moreover, much electric power is consumed to dry the carbon slurries that have been coated on the whole surface. In order to solve the above-mentioned problems and in order to simplify the manufacturing process of a color cathode-ray tube and to decrease electric power, so far there has been known a method of forming a fluorescent screen by a transfer method.

A fluorescent screen is formed by a transfer method as follows. A transfer sheet composed of at least adhesive layers and fluorescent substance layers and which is supplied from a supply reel and rewound by a take-up reel is overlaid on the inner surface (inner surface on which carbon stripes are formed) of the panel of a cathode-ray tube, and the transfer sheet is joined to the inner surface of the panel with application of heat and pressure with the transfer roller while the transfer roller rotatably moves over the inner surface of the panel from one end to the other end of the inner surface of the panel. After the transfer sheet has been joined to the inner surface of the panel, the transfer roller is released and the transfer film is stripped, whereafter a fluorescent substance layer of first color, e.g. green fluorescent substance layer is transferred to the whole surface of the inner surface of the panel. Thereafter, the resultant product is exposed with irradiation of ultraviolet rays by using a color selection structure as an optical mask, developed by a suitable method such as rinsing by water, and dried to thereby form a green fluorescent substance stripe. By similar methods, a fluorescent substance stripe of second color, e.g. blue fluorescent substance stripe and a fluorescent substance stripe of third color, e.g. red fluorescent substance stripe are formed, in that order.

However, according to the fluorescent screen forming method and fluorescent screen forming apparatus based on the conventional transfer method, because panel pins for supporting the color selection structure are protruded from the inner surface of the panel skirt portion, it is difficult to join the transfer film up to the end edges of the inner surface of the panel, and hence an effective display area (what might be called an effective screen) is limited unavoidably. On the other hand, it is desired that the transfer sheet can be transferred over the whole area of the inner surface of the panel including the end edges under uniform transfer pressure without fogging produced in the fluorescent substance layers and without wrinkles produced in the fluorescent substance layers at the corner portions.

DISCLOSURE OF THE INVENTION

The present invention is to provide a fluorescent screen forming method in which an effective display area can be enlarged and which can be made highly reliable, and a fluorescent screen forming apparatus therefor.

The present invention is to provide a cathode-ray tube in which an effective display area can be enlarged and which can be made highly reliable.

A fluorescent screen forming method according to the first invention is a fluorescent screen forming method in which a fluorescent screen is formed on a panel by using a transfer film including at least adhesive layers and component layers that serve as components of a fluorescent screen, comprising the steps of lowering the transfer film to somewhere above the inner surface of the panel by the transfer roller, moving the pressing start end portion of the transfer roller up to the position corresponding to the end edge of the inner surface of the panel, and pushing the transfer roller downwards onto the end edge of the inner surface of the panel to start pressing the transfer film.

A fluorescent screen forming apparatus according to the first invention is a fluorescent screen forming apparatus for forming a fluorescent screen on a panel, comprising a supply means for supplying a transfer film composed of at least adhesive layers and component layers serving as components of the fluorescent screen, a transfer roller for transferring the transfer film onto the panel with application of heat and pressure and a control means for controlling the supply means and the transfer roller, wherein the transfer roller lowers the transfer film to somewhere above the inner surface of the panel and the transfer roller has moved its pressing start end portion up to the position corresponding to the end edge of the inner surface of the panel, whereafter the transfer roller is pushed downwards onto the end edge of the inner surface of the panel to start pressing the transfer film.

A cathode-ray tube manufactured by using a fluorescent screen forming method according to the first invention is a cathode-ray tube in which a fluorescent screen is formed on a panel, comprising component layers that serve as components of the fluorescent screen formed up to the end edge of the inner surface of the panel, the component layers being formed on the transfer film under the condition in which pressing conditions of the transfer roller are determined to be the same on the whole area of the inner surface of the panel.

A fluorescent screen forming method according to the second invention is a fluorescent screen forming method for forming a fluorescent screen on a panel., comprising the steps of overlaying a transfer film composed of at least adhesive layers and component layers serving as components of the fluorescent screen layer on the panel and inclining the panel so that the end edge of the side pressed by the transfer roller is faced downwards when the transfer roller urges the transfer film against the end edge portion of the inner surface of the panel. Further, while the panel is being inclined, it is possible to press the transfer roller in which portions corresponding to the peripheral portion and the curved portions of the corner portions of the inner surface of the panel are formed as the same shapes of the curved portions.

A fluorescent screen forming apparatus according to the second invention is a fluorescent screen forming apparatus for forming a fluorescent screen on a panel, comprising a supply means for supplying a transfer film composed of at least adhesive layers and component layers serving as components of the fluorescent screen, a transfer roller for rotatably moving the transfer film overlaid on the panel while heating and pressing the transfer film, an inclining means for selectively inclining the panel held on a table to one or the other transfer direction, and a control means for controlling the supply means, the transfer roller and the inclining means. The transfer roller can make its portions corresponding to the peripheral portion and the curved portions of the corner portion of the inner surface of the panel become the same curved shape as those of the curved portions.

A cathode-ray tube manufactured by using a fluorescent screen forming method according to the second invention is a cathode-ray tube in which a fluorescent screen is formed on a panel, wherein the component layers that serve as the components of the fluorescent screen are uniformly formed near the curved portions of the end edges of the inner surface of the panel or boundaries between the curved portions.

A fluorescent screen forming method according to the third invention is a fluorescent screen forming method for forming a fluorescent screen on a panel, comprising the steps of overlaying a transfer film composed of at least adhesive layers and component layers serving as components of the fluorescent screen on the panel, and bonding the transfer film on the panel with application of heat and pressure to transfer the component layers onto the panel while the transfer roller is being moved from one end to the other end of the transfer film at least once.

A fluorescent screen forming apparatus according to the third invention is a fluorescent screen forming apparatus for forming a fluorescent screen on a panel, comprising a supply means for supplying a transfer film composed of at least adhesive layers and component layers serving as components of the fluorescent screen, a transfer roller being moved from one end to the other end of the transfer film at least once while heating and pressing the transfer film overlaid on the panel, and a control means for controlling the supply means and the transfer roller.

A cathode-ray tube manufactured by using a fluorescent screen forming method according to the third invention is a cathode-ray tube in which a fluorescent screen is formed on a panel, component layers serving as components of the fluorescent screen being formed of transferred layers that are transferred from a transfer film by moving a transfer roller from one end to the other end of the transfer film at least once.

According to the fluorescent screen forming method of the first invention, the transfer roller lowers the transfer film to somewhere above the inner surface of the panel and the transfer roller is moved up to the positions of the end edge positions of the inner surface of the panel, whereafter the transfer roller is moved downwards onto the end edges of the inner surface of the panel in unison with the transfer film to start pressing the transfer film. Therefore, the transfer roller can reach the end edges of the panel, and hence transfer the components layers of the fluorescent screen onto the end edges of the inner surface of the panel.

As described above, according to the fluorescent screen forming method of the first invention, when the transfer film is transferred onto the panel by the transfer roller, since the transfer roller that moves downwards together with the transfer film is temporarily stopped within the panel and moved toward the side of the end edges, whereafter the transfer roller moves downwards in the inner surface of the panel to start pressing the transfer film, the transfer roller is able to transfer the component layers of the fluorescent screen onto the end edges of the inner surface of the panel, and hence an effective display area can be enlarged by the transfer. Further, since the transfer roller starts pressing the transfer film from the end edges of the inner surface of the panel and the component layers are transferred onto the entire surface of the inner surface of the panel at the same transfer pressure, fogging can be prevented from being produced in the fluorescent substance layers and the fluorescent substance layers of the corner portions can be prevented from being wrinkled, and hence a highly-reliable fluorescent screen can be formed. A transfer process can be made efficient, and accordingly, work efficiency can be improved. Since the fluorescent screen is formed by using the transfer method, it becomes possible to form a highly-reliable fluorescent screen more inexpensively as compared with a slurry method.

In the fluorescent screen forming apparatus of the first invention, the transfer roller is temporarily stopped together with the transfer film at the position in which it does not reach the inner surface of the panel within the panel and moved toward the side of the end edges of the inner surface of the panel, whereafter the transfer roller moves downwards onto the end edges of the inner surface of the panel to start pressing the transfer film under control of the control means.

Accordingly, the component layers of the fluorescent screen can be transferred fully onto the end edges of the inner surface of the panel.

As described above, according to the fluorescent screen forming apparatus of the first invention, since the transfer roller that moves downwards together with the transfer film is temporarily stopped within the panel and moved toward the sides of the end edges, whereafter the transfer roller moves downwards onto the inner surface of the panel to start pressing the transfer film, the transfer film can be fully joined to the end edges of the inner surface of the panel, and hence the effective display area can be enlarged by the transfer. Further, since the transfer film can be joined on the whole surface of the panel including the end edges at a uniform transfer pressure, fogging can be prevented from being produced in the fluorescent substance layers, the fluorescent substance layers of the corner portions can be prevented from being wrinkled, and hence the fluorescent screen can be formed inexpensively.

According to the fluorescent screen forming method of the second invention, since the panel is inclined such that the end edge of the pressed side is faced downwards, the surfaces of the curved portions of the end edges including the corner portions are placed in substantially the horizontal state. Since the transfer roller urges the transfer film against the end edge portions, the transfer film can be bonded to the end edge portions, in particular, the curved portions stably so that the curved portions can be prevented from being wrinkled.

As described above, according to the fluorescent screen forming method of the second invention, when the transfer film is joined to the end edge portions including the corner portions of the inner surface of the panel, since the transfer film is bonded to the end edge portions while the panel is being inclined, the transfer film can be bonded to the curved portions of the end edges without wrinkles, and hence the highly-reliable fluorescent screen can be formed. Since the fluorescent screen can be stably transferred to the end edges including the corner portions of the panel, the effective display area can be enlarged.

According to the fluorescent screen forming apparatus of the second invention, when the transfer film is bonded to the end edge portions including the corner portions of the inner surface of the panel, the panel is inclined by operating the panel inclining means such that the curved portions of the end edges of the panel are placed in substantially the horizontal state. Since the transfer film is joined to the corner portions by the transfer roller in this state, the transfer roller is stably bonded to the end edge portions stably and hence wrinkles and the like can be prevented from being produced in the end edges of the inner surface of the panel.

As described above, according to the fluorescent screen forming apparatus of the second invention, since the fluorescent screen forming apparatus includes the panel inclining means, when the transfer film is bonded to the end edge portions including the corner portions of the inner surface of the panel, by inclining the panel, the transfer film can be stably joined to the curved portions of the end edges including the corner portions of the panel without wrinkles. Thus, it is possible to form the highly-reliable fluorescent screen whose effective display area is large.

According to the fluorescent screen forming method of the third invention, since the transfer film is overlaid over the panel and bonded onto the panel with application of heat and pressure while the transfer roller is being moved from one end to the other end of the transfer film at least once, a speed at which the transfer roller may move can increase, and hence the transfer process can be made more efficient.

As described above, according to the fluorescent screen forming method of the present invention, when the transfer film is transferred onto the panel by the transfer roller, the transfer film is transferred onto the panel while the transfer roller is moved over the panel from one end to the other end of the transfer film at least once, whereby a speed at which the transfer roller may move can increase and the transfer process can be made more efficient, and accordingly, a work efficiency can be improved.

Since the fluorescent forming apparatus according to the third invention includes the transfer roller that moves over the panel from one end to the other end of the transfer film at least once while heating and pressing the transfer film overlaid on the panel, a speed at which the transfer roller may move can increase, and hence the transfer process can be made more efficient. The adhesive layer and the component layers of the transfer film are joined to the panel uniformly so that it becomes possible to form the highly-reliable fluorescent screen.

As described above, according to the fluorescent forming apparatus of the third invention, since the transfer roller is moved over the panel from one end to the other end of the transfer film at least once when the transfer film is transferred to the panel, the transfer speed can be increased, and hence the transfer can be made more efficient. Since the adhesive layer of the transfer film can be uniformly joined to the whole surface, reliability of the transfer can be improved. The fluorescent screen can be produced more inexpensively. The panel corner portions can be transferred satisfactorily, and hence the effective picture can be enlarged by the transfer.

Since the above-mentioned cathode-ray tubes manufactured by using the fluorescent screen forming method according to the first, second and third inventions include the fluorescent screen formed by the above-mentioned transfer methods, it is possible to provide a highly-reliable cathode-ray tube of which the effective screen is large. The cathode-ray tube can be made more inexpensive.

BEST MODE FOR CARRYING OUT THE INVENTION

A fluorescent screen forming method, a fluorescent screen forming apparatus and a cathode-ray tube according to an embodiment of the present invention will be described in detail below with reference to the drawings.

Figure 1:
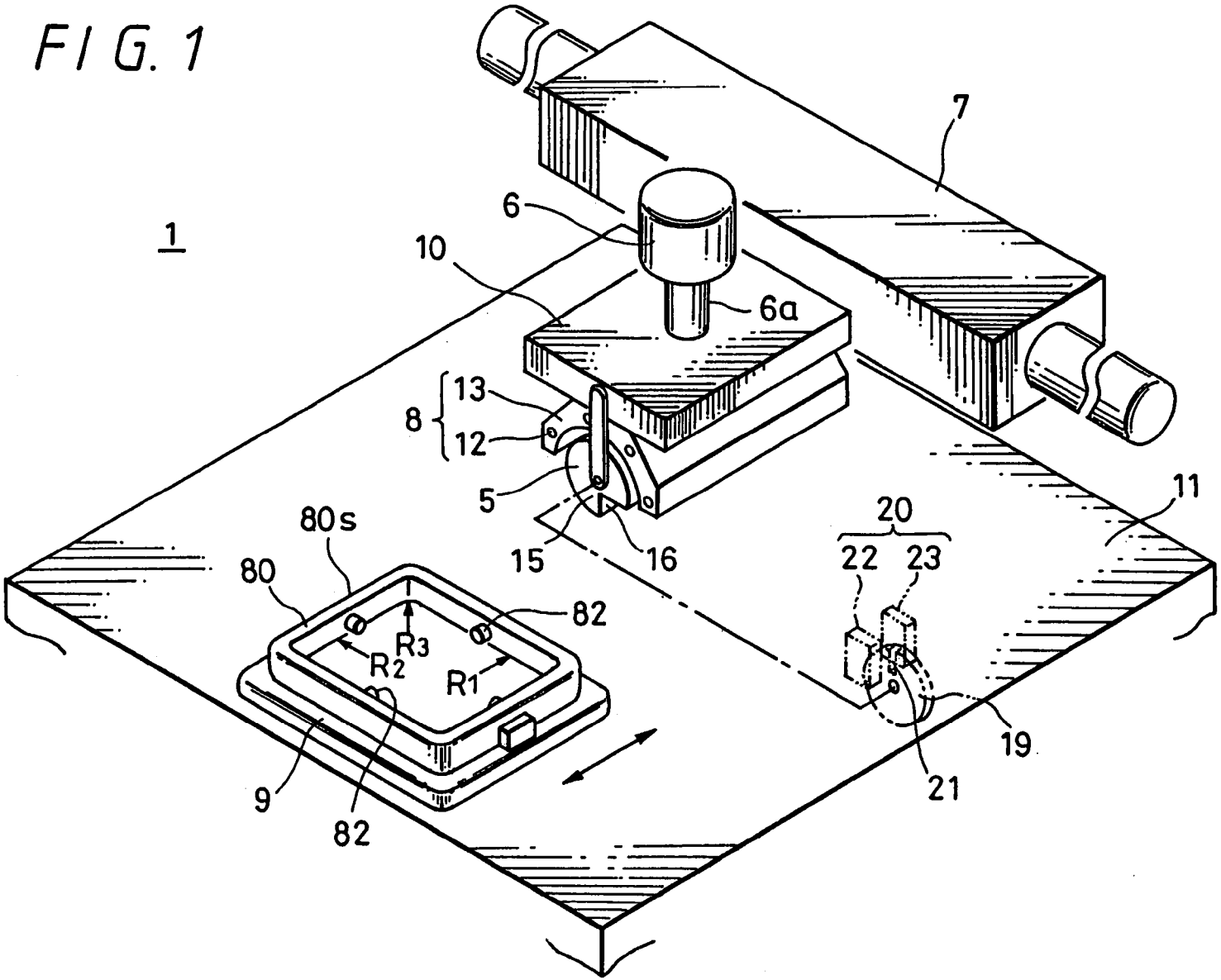
FIG. 1 is a diagram showing an arrangement of a transfer apparatus according to an embodiment of the present invention.
Figure 2:
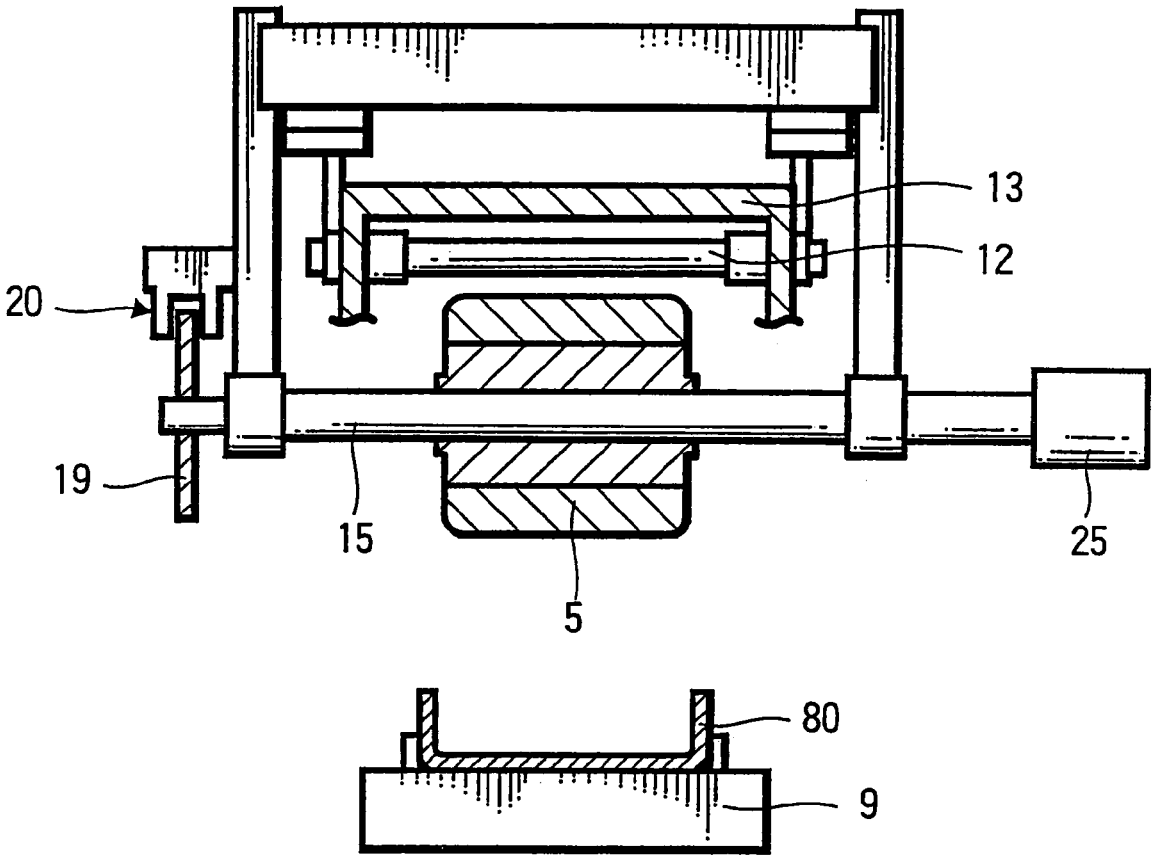
FIG. 2 is across-sectional view showing a main portion of FIG. 1.
Figure 3:
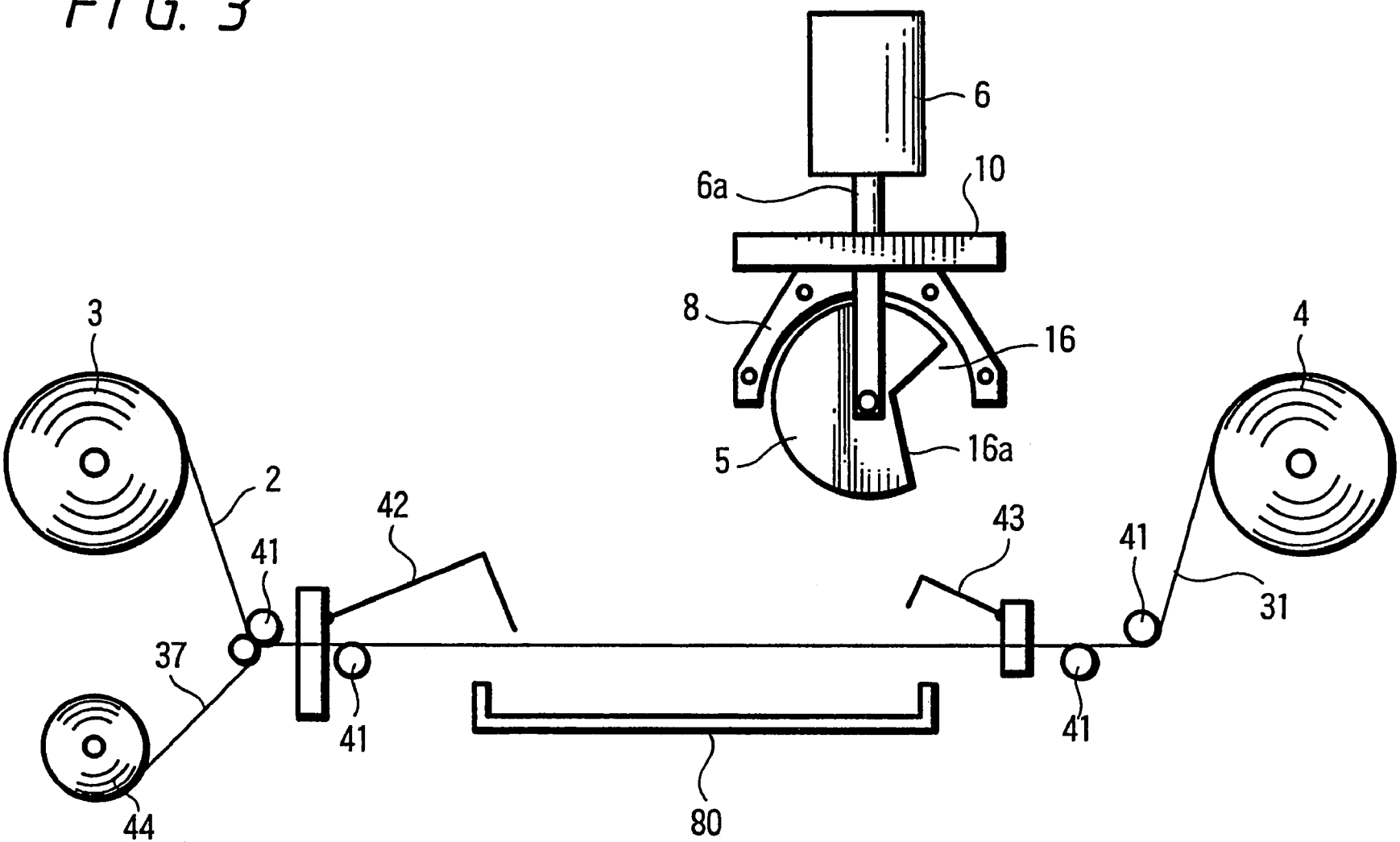
FIG. 3 is a diagram to which reference will be made in explaining a fundamental operation of a transfer apparatus according to the present invention (No. 1)

FIGS. 1 to 3 show a schematic arrangement of a fluorescent screen forming apparatus, i.e., what might be called a transfer apparatus 1 according to an embodiment of the present invention. In this embodiment, the present invention is applied to the transfer apparatus for transferring a fluorescent screen to the panel of a cathode-ray tube.

The transfer apparatus 1 (FIG. 3) according to this embodiment includes a supply reel 3 for supplying a transfer film 2 composed of at least component layers serving as components of a fluorescent screen and adhesive layers, a take-up reel 4 for rewinding an upper film base 31 of the transfer film 2 which has been transferred as will be described later on, a transfer roller, i.e., so-called thermal transfer roller 5, a press means 6 for pressing the thermal transfer roller 5 with pressure, a moving means (FIG. 1) for moving the thermal transfer roller 5 along the transfer direction at a predetermined speed, a heating means 8 for heating the thermal transfer roller 5 up to a predetermined temperature and a panel holder 9 (FIGS. 1 and 2) for holding thereon a panel 80 of a cathode-ray tube.

The panel 80 of the cathode-ray tube (FIG. 1) is shaped so as to have so-called skirt portions 80S rising around the front surface on which a fluorescent screen is formed. Support pins (so-called panel pins) 82 for supporting a color selection structure are provided on the insides of the skirt portions 80S of the four sides, and hence the color selection structure is supported to the panel 80 at four points. The panel 80 according to this embodiment is a panel suitable for use with an oblong and flat surface type cathode-ray tube.

The pressing means 6 is adapted to urge the thermal transfer roller 5 against the inner surface of the panel 80 through the transfer film 2. The pressing means may have an arrangement in which it can be driven to lower the thermal transfer roller to the inner surface of the panel 80 without interruption or it can be driven so as to vary the position at which the thermal transfer roller 5 is lowered. The pressing means 6 may be comprised of an air cylinder, for example. The air cylinder 6, for example, of the pressing means, is secured to a support portion, not shown, and a tip end of its cylinder rod 6*a* is fixed to the center of a fixed base plate 10 that supports the heating means 8 and the thermal transfer roller 5.

The heating means 8 is adapted to heat the thermal transfer roller 5 up to a predetermined temperature. The heating means 8 of this embodiment is semi-cylindrical in shape and is extended along the longitudinal direction of the roller above the thermal transfer roller 5. In this case, a bar-like heater 12 is housed within a heater cover 13. The thermal transfer roller 5 is heated by this heating means 8 up to a predetermined constant temperature, i.e., a temperature at which a thermal transfer process becomes possible, e.g. about 120° C. When the thermal transfer roller 5 is heated, the thermal transfer roller 5 is rotated so that the whole of the roller may be uniformly heated up to a control temperature. The heating means 8, accordingly, the heating heater may be either an indirect type heater type like this embodiment or may be a direct type heater for directly heating the thermal transfer roller 5 from the center thereof.

The panel holder 9 is located above a support table 11 such that it can move between the position at which panels may be supplied to the apparatus and the position beneath the thermal transfer roller 5. The panel holder 9 may fix a panel 80 by vacuum adsorption, for example, in the state in which it holds the panel 80 so that the inner surface of the panel may be directed in the upward. The panel holder 9 may be held at a room temperature or the temperature of the panel 80 may be kept at a room temperature to 40 to 45° C. by a heater provided under the panel holder 9.

The panel holder 9 may selectively incline the panel 80 to one direction or to the other direction with respect to the transfer direction when the transfer film is transferred.

The moving means 7 may be set by control means according to the need so that it can move the thermal transfer roller 6 in the inward direction within the panel 80 or reciprocate the thermal transfer roller within the panel once or reciprocate the thermal transfer roller within the panel a plurality of times when the transfer film is transferred.

The thermal transfer roller 5 is attached to the center of a horizontal shaft 15 so as to become rotatable and has a notch portion 16 of a length approximate to a width that can be inserted into the panel 80, i.e., the inside width (in this embodiment, width of the vertical direction of the screen) of the panel 80 in the state in which it is heated at a predetermined temperature) or a length slightly shorter than this width. This notch portion is formed on a portion of the outer surface over the whole length of the longitudinal direction such that the thermal transfer roller 5 may be located at the transfer start portion so as to avoid the panel pins 82 formed on the insides of the skirt portions 80*s* of the panel 80. The thermal transfer roller 5 may be formed of an elastic roller having a hardness ranging of from about 70° to 90°, e.g. about 80°, for example, silicon roller made of a suitable material such as a heat-resisting silicon rubber.

The thermal transfer roller 6 is formed so as to become able to bond the transfer film to one to the other end of the inner surface of the panel 80 with application of heat and pressure while it rotates once from one end to the other end of the notch portion 16.

Figure 8A:
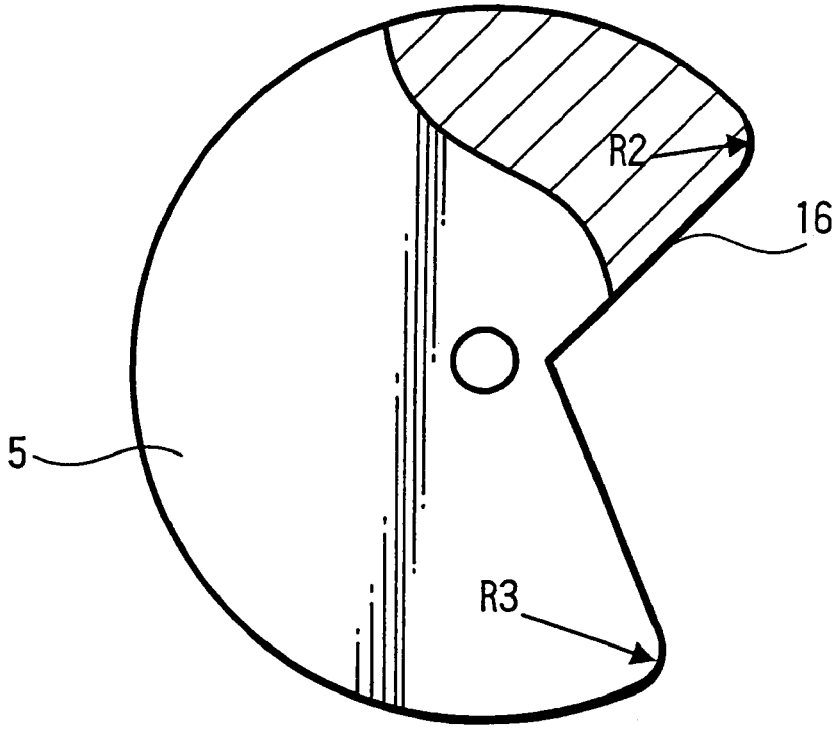
FIGS. 8A and 8B are diagrams showing a shape of a transfer roller according to the present invention.
Figure 8B:
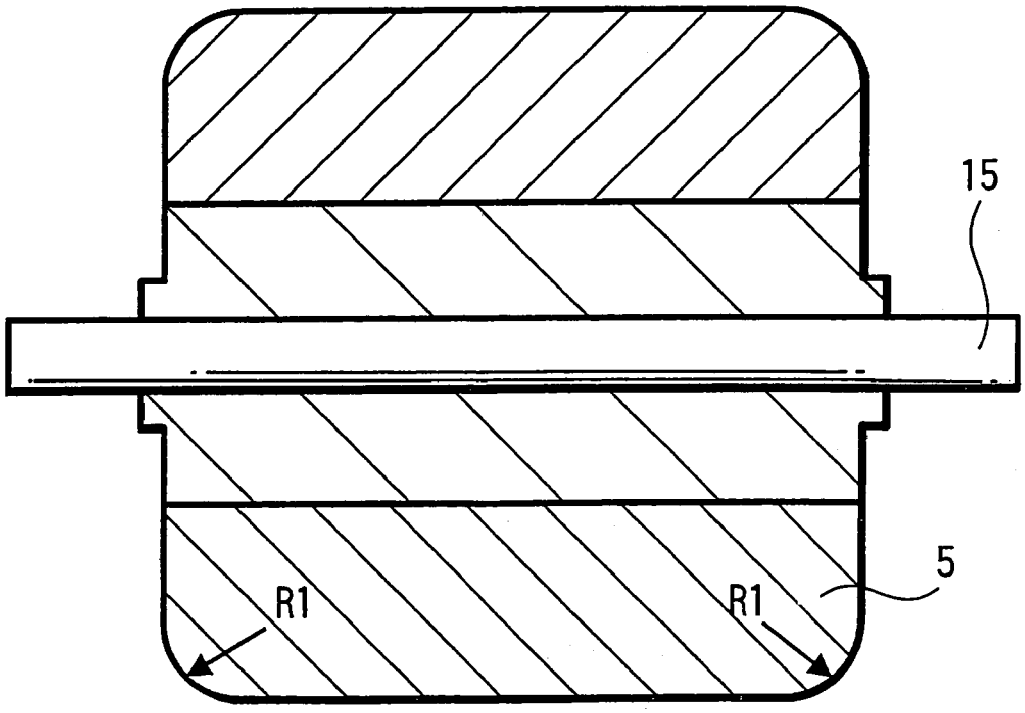

Further, in the thermal transfer roller 5, as shown in FIG. 8B, the peripheral edges of both ends of the axial direction of the thermal transfer roller 6 are formed like curved shapes (=$R_1$) that are the same as those (i.e., curved surface [radius of curvature $R_1$] of the boundary between the inner surface of the panel and the skirt portion 80*s*, and see FIG. 1) of the curved portions of the upper and lower end sides of the inner surface of the oblong panel 80. As shown in FIG. 8A, both end sides of the notch portion of the thermal transfer roller 5 are formed with the same curved shapes (=$R_2$) as those (i.e., curved surface [radius of curvature $R_2$] of the boundary between the inner surface of the panel and the skirt portion 80*s* and see FIG. 1) of the curved portions of the right and left end sides of the inner surface of the panel 80. Since the corner portion of the notch portion 16 of the thermal transfer roller 5 is the curved portion (i.e., since it is the joint portion of $R_1$ and $R_2$, it is formed as a curved surface [radius of curvature $R_3$] and see FIG. 1) of the corner portion of the inner surface of the panel 80 as shown in FIG. 8A, it is formed as the same curved shape (=$R_3$).

There is provided a detecting device 18 that can detect the position at which the thermal transfer roller 5 may rotate when the apparatus begins to transfer the transfer film, i.e., the position at which the thermal transfer roller rotates from one end to the other end of the notch portion 16. This detection device 18 is composed of a detection plate 19 and a photoelectric sensor 20. In this embodiment, the detection plate 19 is coaxial with the thermal transfer roller 5 so that it may rotate in unison with the rotation of the thermal transfer roller 5. Specifically, the thermal transfer roller 5 has a drive shaft 15 and the detection plate (so-called encoder) 19 that can rotate concurrently with the rotation of the thermal transfer roller 5 and which can detect the position (position at which one end of the notch portion 16 can rotate at the end sides of the inner surface of the panel after it has avoided the panel pins and reached the inner surface of the panel, as will become apparent later on) of the thermal transfer roller 5 is attached to one end of this drive shaft. This detection plate 19 is shaped like a disk and has a slit 21 of a straight-line shape formed at one portion of its circumferential direction along the radius direction. This slit 21 is attached to the drive shaft 15 so that an angle between it and one end edge 16*a* of the notch portion 16 may become "$_1$ (e.g. see FIG. 11A)

The photoelectric sensor 20 composed of a pair of light-emitting element 22 and light-receiving element 23 is located across this detection plate 19 (see FIGS. 1 and 2). In this case, when the slit 21 of the detection plate 19 reaches the vertical position, the light-receiving element 23 receives light from the light-emitting element 22 through the slit 21 to thereby detect that the thermal transfer roller 5 reaches the position at which the thermal transfer roller rotates when the transfer apparatus begins to transfer the transfer film. A motor 25 for rotating the thermal transfer roller 5 is attached to the other end of the drive shaft 15 (see FIG. 2).

The take-up reel 4, the thermal transfer roller 5, the moving means 7, the panel holder 9 and the like are rotated by suitable drive sources such as motors, their positions are detected by a rotary sensor and they are constructed such that the whole of the apparatus may be controlled by a control means such as a microcomputer. The transfer apparatus 1 includes a control panel for entering initial values into the control means, although not shown.

As shown in FIG. 3, above the transport path of the transfer film 2 that is supplied from the supply reel 3 and rewound by the take-up reel 4 through guide rollers 41, there is provided a pair of L-like transfer film presser members 42 and 43 at the positions corresponding to both ends of the panel 80 to push the transfer film 2 from above to bring the transfer film to somewhere above within the panel 80 when the transfer film is transferred. One presser member 42 is located at the fixed position and one end thereof is made rotatable so that the transfer film 2 may be pressed by the skirt portions of the panel when it is rotated in the lower direction. The other presser member 43 is provided so as to become movable in the upper and lower direction so that the transfer film 2 may be pressed by the skirt portions of the panel when it is moved toward the lower direction. Further, there is provided a second take-up reel 44 for rewinding a lower film base, stripped to expose adhesive layers, which will be described later on, from the transfer film 2 supplied from the supply reel 3 when the transfer film is transferred.

In this embodiment, particularly when the transfer apparatus begins to transfer the transfer film, the thermal transfer roller 5 that is lowered in unison with the transfer film 2 is temporarily halted in somewhere within the panel. Then, after the thermal transfer roller has been moved to the end portion where the pressing means starts to press the thermal transfer roller 5, i.e., the position at which the end side of the notch portion 16 opposes the end edge of the inner surface of the panel, it is lowered up to the end edge of the inner surface of the panel in unison with the transfer film 2, whereby the thermal transfer roller 5 is driven to start pressing the transfer film 2.

Figure 18:
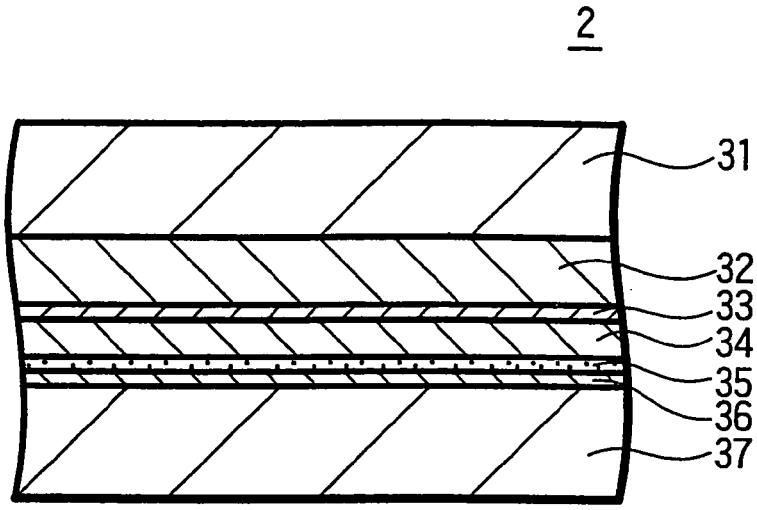
FIG. 18 is a cross-sectional view showing a transfer film according to an embodiment of the present invention.

FIG. 18 shows an example of the transfer film 2 used in this embodiment. This transfer film 2 comprises an upper film base (e.g. polyethylene terephthalate [PET] base) 31, a cushion layer 32, an upper stripping layer 33 and component layers serving as components of the fluorescent screen, e.g. a photosensitive fluorescent substance layer 34, a photosensitive adhesive layer, a lower stripping layer 36 and a lower film base (PET base) 37 which are laminated, in that order from above. As specific examples of thicknesses of respective layers, the upper and lower film bases 31, 37 have a thickness of approximately 50 μm, the cushion layer 32 has a thickness of approximately 40 μm and the fluorescent substance layer 34 has a thickness of approximately 3 μm.

When the transfer film 25 is in use, the lower film base 37 is stripped from the lower stripping layer 36 to expose the adhesive layer 35 and the transfer film 2 is bonded to the inner surface of the panel through this adhesive layer 35. After the transfer film has been joined to the inner surface of the panel, the cushion layer 32 and the upper film base 31 are stripped from the upper stripping layer 33, and hence the fluorescent substance layer 34 is left on the inner surface of the panel. In this transfer film 2, adhesiveness of the upper stripping layer 33 is set to be larger than that of the adhesive layer 35 with the panel so that the adhesive layer 35 and the fluorescent substance layer 34 may be cut from the boundary between the bonded portion and the portion that was not bonded after the fluorescent substance layer 34 has been joined to the inner surface of the panel with application of heat and pressure.

Next, a transfer method will be described together with an operation of the above-mentioned transfer apparatus 1.

First, before the transfer apparatus begins to transfer the transfer film to the inner surface of the panel, the thermal transfer roller 5 is being rotated while a temperature thereof is being controlled. Specifically, the thermal transfer roller 5 is being rotated in the state in which it is heated at a desired temperature by the heating means 8. The panel 80 on which the fluorescent screen should be formed is conveyed and set onto the panel holder 9 with its inside surface directed upwards. The panel holder 9 is moved to the predetermined position just under the transfer roller 5. When receiving a signal indicative of the fact that the panel 80 has been reached the predetermined position, preparations for activating the transfer apparatus 1 are completed.

Next, fundamental operations will be described with reference to FIGS. 3 to 5. Specifically, as shown in FIG. 3, the transfer roller 5 is placed in the standby mode at the transfer start position. The transfer film 2 is supplied from the supply reel 3, and during the transfer film is being supplied from the supply reel, the second take-up reel 44 rewinds the lower film base 37 to expose the adhesive layer 35. Then, the detecting means 20 detects the position of the slit 21 of the detection plate 19 to sense that the thermal transfer roller 5 has reached the predetermined rotation position. At that time, one end edge 16*a* of the notch portion 16 of the thermal transfer roller 5 is opposed to the position at which it may not contact with the panel pin 82 (more specifically, the presser member 43 in FIG. 4). When the thermal transfer roller 5 reached this predetermined rotation position, the heating means 8 is de-energized, and hence the thermal transfer roller 5 stops rotating. In this state, the thermal transfer roller 5 becomes able to rotate freely.

Figure 4:
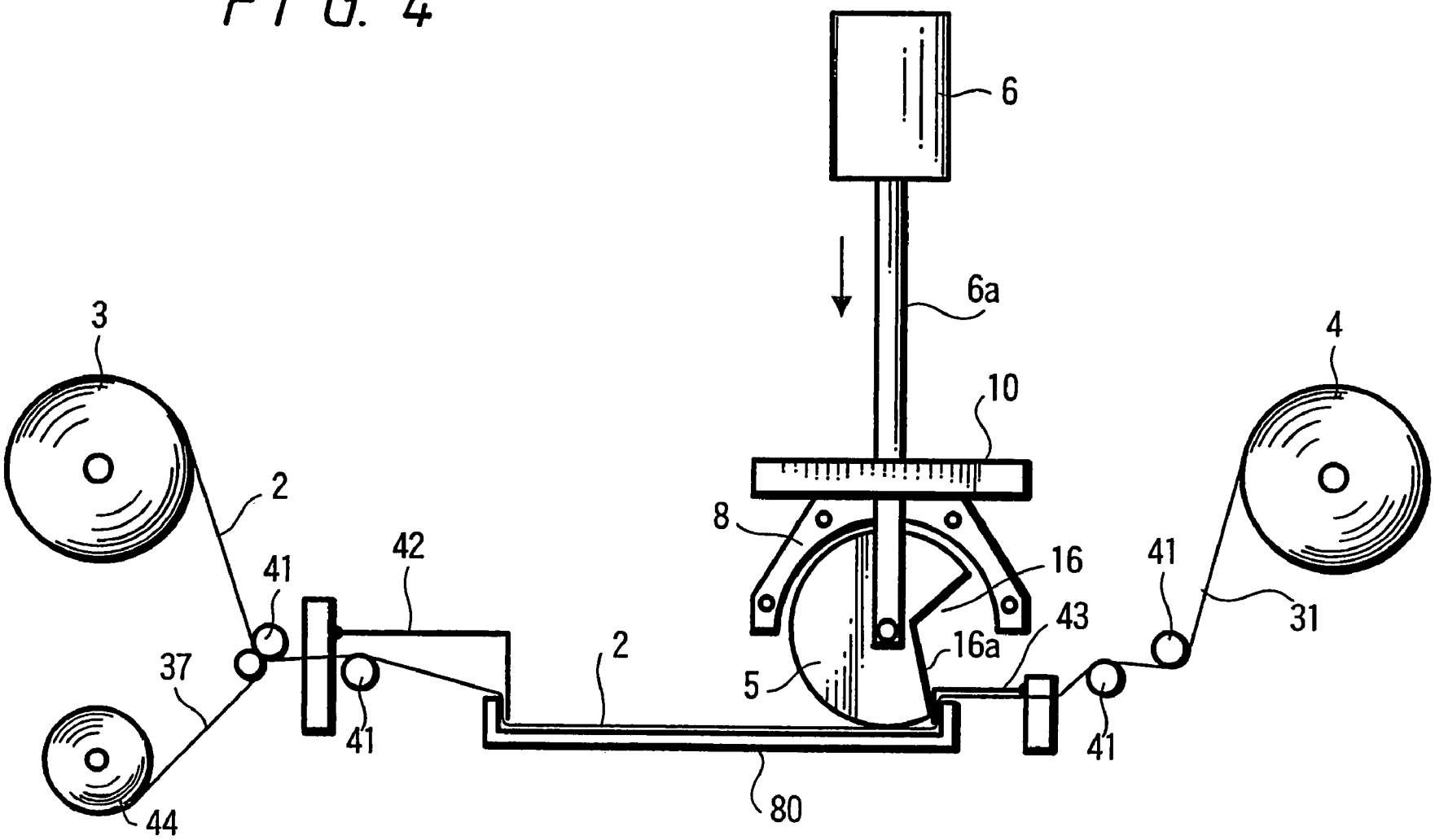
FIG. 4 is a diagram to which reference will be made in explaining a fundamental operation of a transfer apparatus according to the present invention (No. 2)

Next, as shown in FIG. 4, the pair of presser members 42, 43 is driven to push the transfer film 2 into the panel 80 while they are pressing the transfer film from above, and the transfer film 2 is temporarily pressed by the presser members 42, 43. Thereafter, the cylinder 6 that is the pressing means is driven to lower the thermal transfer roller 5 to further push the transfer film 2 into the inner surface of the panel 80.

Figure 5:
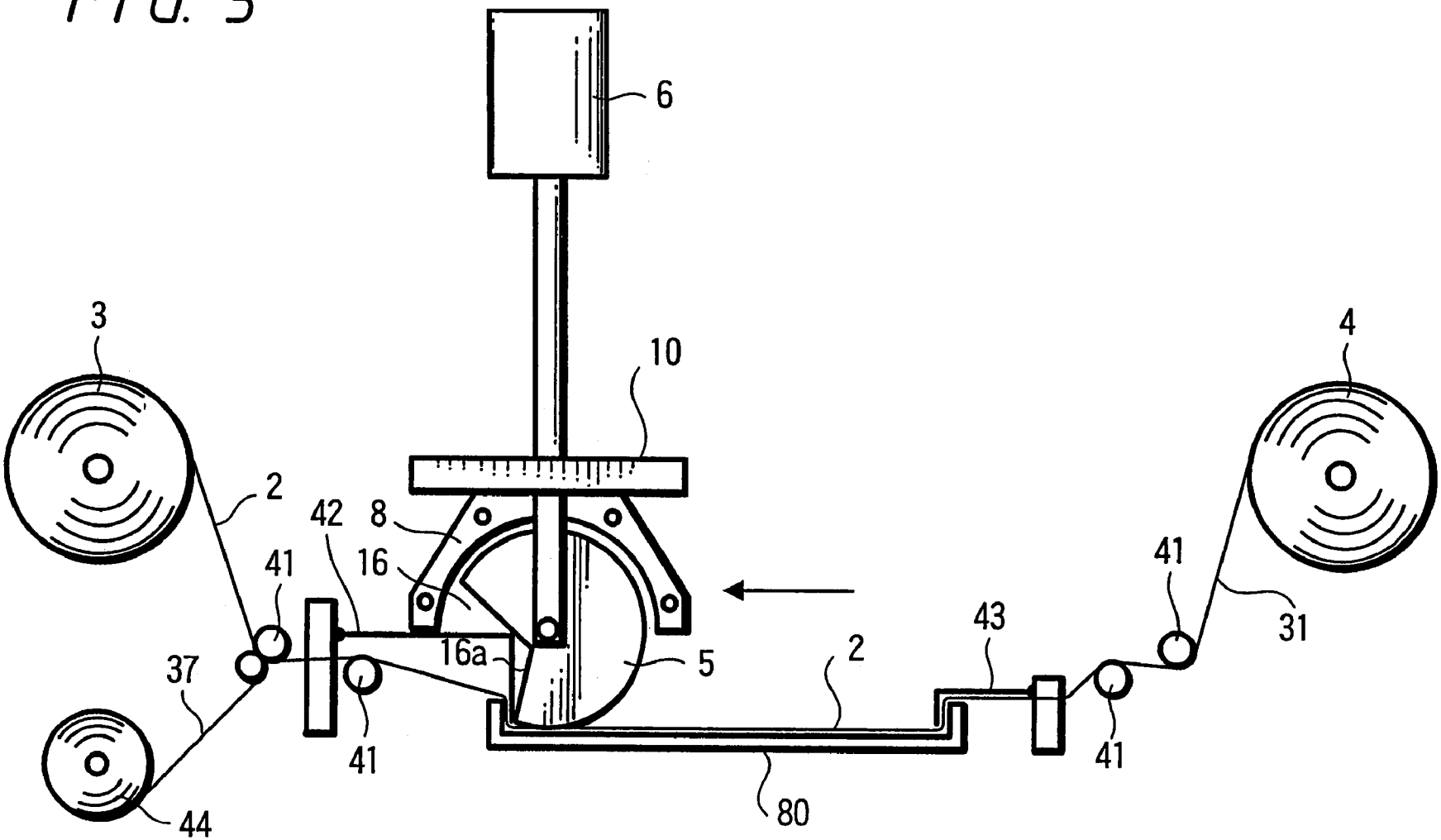
FIG. 5 is a diagram to which reference will be made in explaining a fundamental operation of a transfer apparatus according to the present invention (No. 3)

Next, as shown in FIG. 5, the moving means 7 is driven to translate the thermal transfer roller 5 to the inner surface of the panel 80 from one end to the other end. At that time, since the thermal transfer roller 5 is in contact with the inner surface of the panel 80 through the transfer film 2, the thermal transfer roller 5 is moving while it is rotating in the horizontal direction (so-called rotatable movement). This thermal transfer roller 5 heats and presses the transfer film 2 so that the transfer film may be joined to the inner surface of the panel through the adhesive layer 35. After the transfer film 2 having an area equal to that of the inner surface of the panel has been bonded to the inner surface of the panel, the thermal transfer roller 5 and the presser members 42, 43 are returned to the standby position shown in FIG. 3. Concurrently therewith, when the transfer film 2 is rewound by the first take-up reel 4, the upper film base 31 and the cushion layer 32 are stripped from the transfer film 2 of the portion bonded to the panel together with the stripping layer 33, and the fluorescent substance layer 34 and the adhesive layer 35 of the portions which are not yet bonded with application of heat and pressure are cut from the bonded portions. Thus, only the fluorescent substance layer 34 is remaining on the inner surface of the panel 80 and the transfer process of the fluorescent substance layer 34 is completed.

Figure 19:
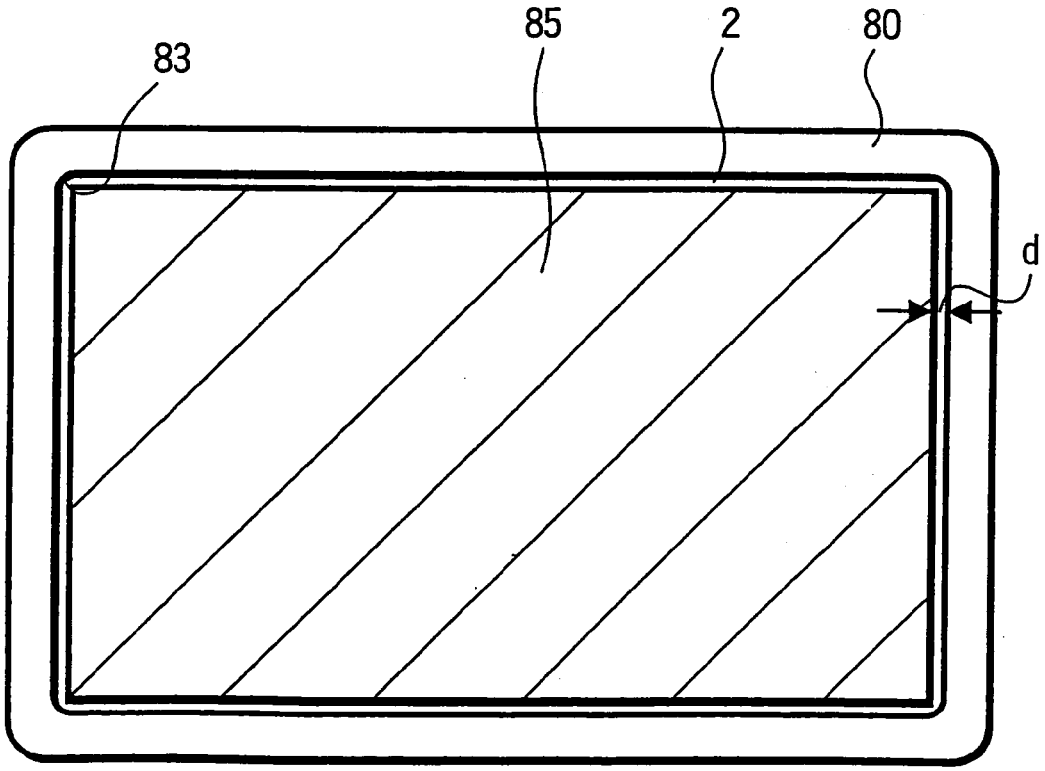
FIG. 19 is a plan view showing a relationship between an effective display area and a transfer area of a transfer film.

In order to increase the effective display area of the cathode-ray tube as wide as possible, the transfer film 2 should be bonded to the inner surface of the panel 80 wide enough so that it may be laid over the curved portion 83 of the boundary between it and the skirt portion 80*s*. Specifically, since it is difficult to precisely determine the transfer position of the transfer film 2 when the transfer film 2 is transferred to the inner surface of the panel, as shown in FIG. 19, the transfer film has to be formed wider than the fluorescent screen formed on the inner surface of the panel 80, i.e., so-called effective display area 85 by a predetermined dimension d, e.g. about 2 mm on its surrounding portion. In order to make the effective display area 83 become closer to the peripheral edge of the panel, the transfer film 2 has to be bonded to the inner surface of the panel in such a manner that it may be extended to the peripheral edge of the panel and the curved portion 83 of the corner portion.

Two methods for bonding the end portion of the transfer film 2 to one end of the inner surface of the panel 80 are available when the transfer apparatus starts transferring the transfer film 2 to the inner surface of the panel.

Figure 9:
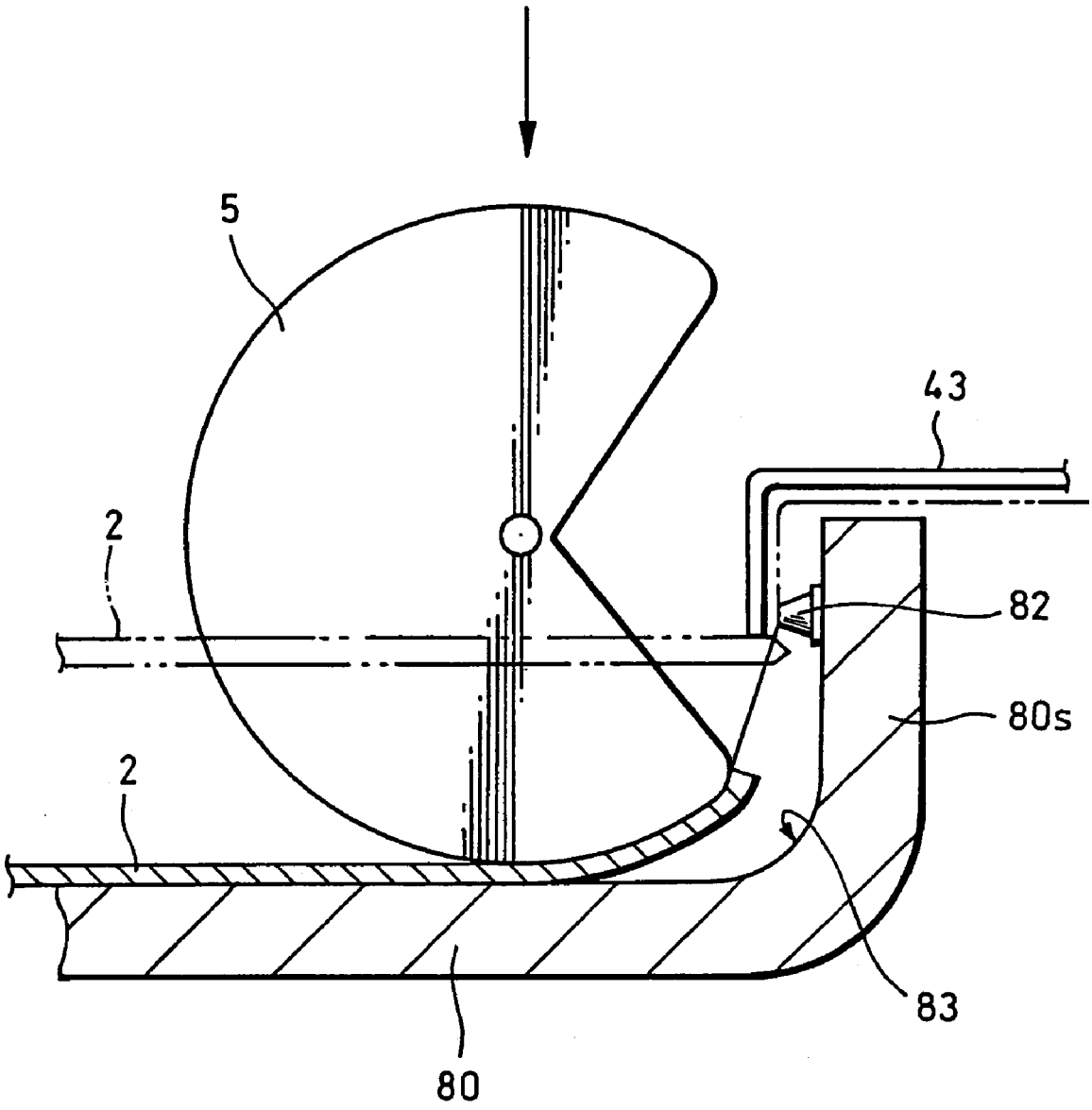
FIG. 9 is an explanatory diagram of a main portion showing an example in which a transfer roller is operating when a transfer process begins (No. 1)
Figure 10:
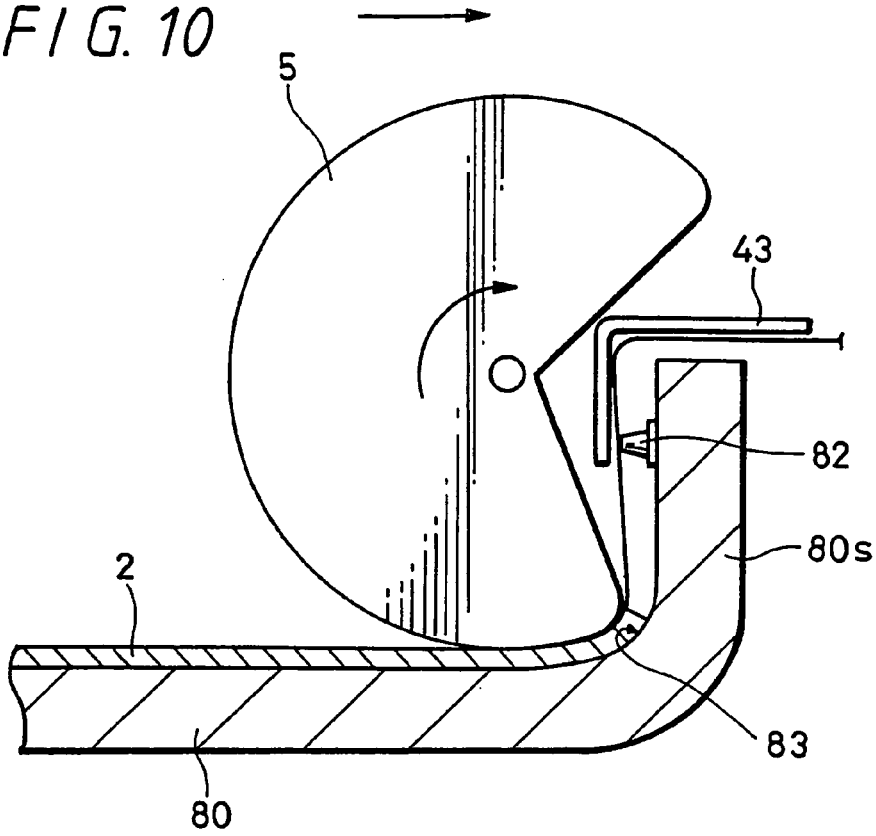
FIG. 10 is an explanatory diagram of a main portion showing an example in which a transfer roller is operating when a transfer process begins (No. 2)

FIGS. 9 and 10 show one of such two methods. According to this method, as shown in FIG. 9, the thermal transfer roller 5 is lowered in the vertical direction so as to avoid the presser member 43 while it is pushing the transfer film 2 downwards with pressure. When the thermal transfer roller 5 reaches the inner surface of the panel 80, as shown in FIG. 10, the moving means 7 is driven to rotatably move the thermal transfer roller 5 temporarily in the opposite direction, i.e., in the right-hand side on the sheet of drawing so that the thermal transfer film 2 is bonded to the inner surface of the panel so as to partly overlap the curved portion 83 of the right end edge of the panel beneath the panel pin 82 with application of heat and pressure.

Then, as shown in FIG. 5, the thermal transfer roller 5 is rotatably moved in the left-hand direction on the sheet of drawing, whereby the transfer film 2 is bonded to the inner surface of the panel so as to partly overlap the curved portion 83 of the left end edge of the panel with application of heat and pressure similarly. After the bonding of the transfer film 2 to the inner surface of the panel has been finished, the thermal transfer roller 5 is operated in the manner opposite to that required when the transfer apparatus starts transferring the transfer film, i.e., the thermal transfer roller is slightly returned to the right-hand side from the left end edge and elevated, whereafter it is returned to the standby position.

According to the method shown in FIGS. 9 and 10, the right end edge portion of the panel is heated and pressed twice by the thermal transfer roller 5. As a consequence, the balance of the transfer pressure is changed on the whole surface of the panel (accordingly, the balance of adhesiveness of the fluorescent substance layer onto the panel surface is changed) In worst cases, fogging (mixture of color) tends to easily occur in the fluorescent substance layer. Specifically, the balance of the transfer pressure unavoidably affects exposure and development of the transferred fluorescent substance layer as will be described later on. In particular, the panel end edge portion at its portion that has been heated and pressed by the thermal transfer roller twice in the exposure and development required after the fluorescent substance layer stripe of the color following the second color partly remains, which causes fogging to occur.

FIRST INVENTIVE EXAMPLE

Figure 11:
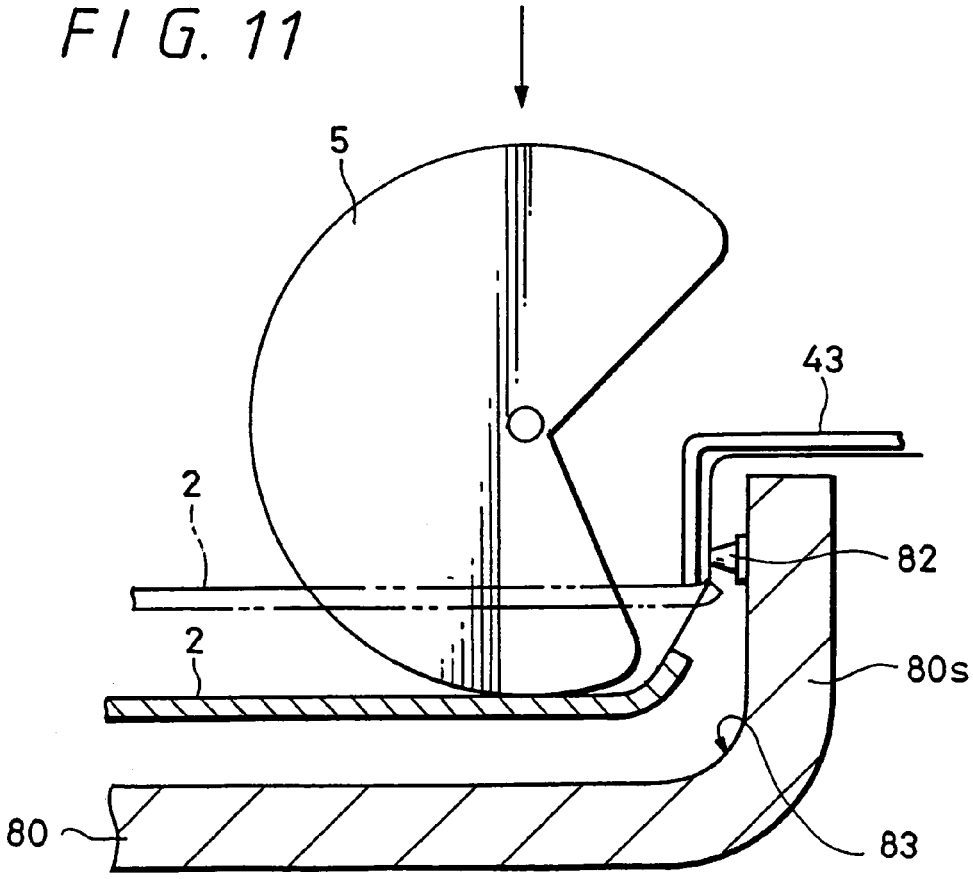
FIG. 11 is an explanatory diagram of a main portion showing an example in which a transfer roller is operating when a transfer process begins according to the present invention (No. 1)
Figure 12:
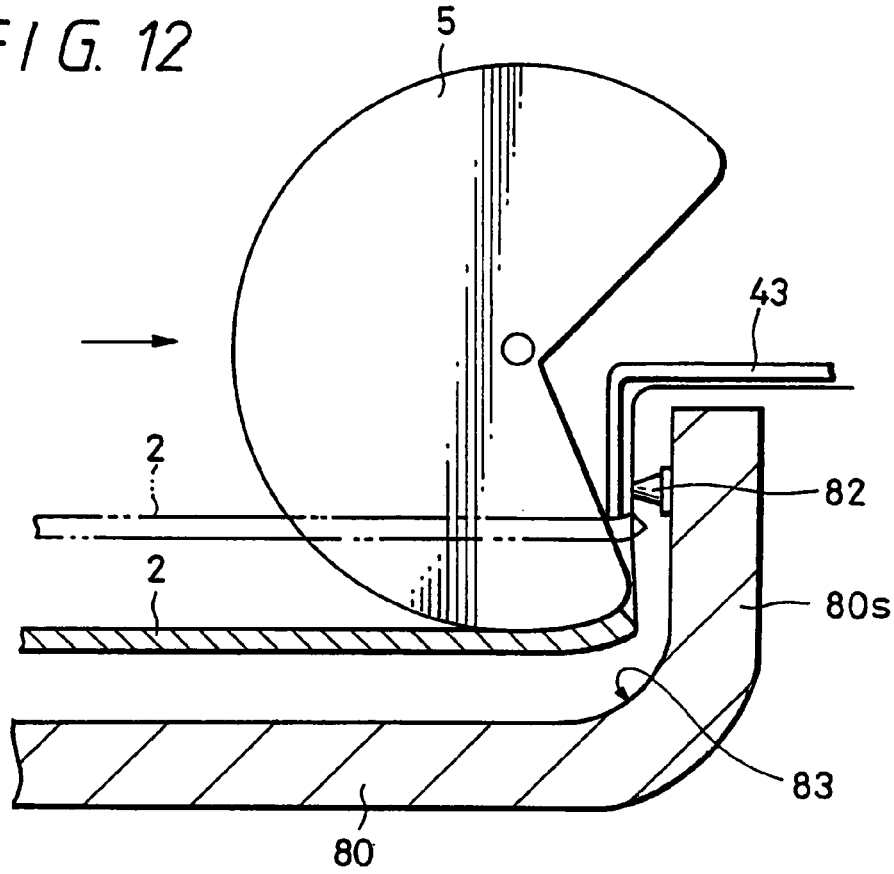
FIG. 12 is an explanatory diagram of a main portion showing an example in which a transfer roller is operating when a transfer process begins according to the present invention (No. 2)
Figure 13:
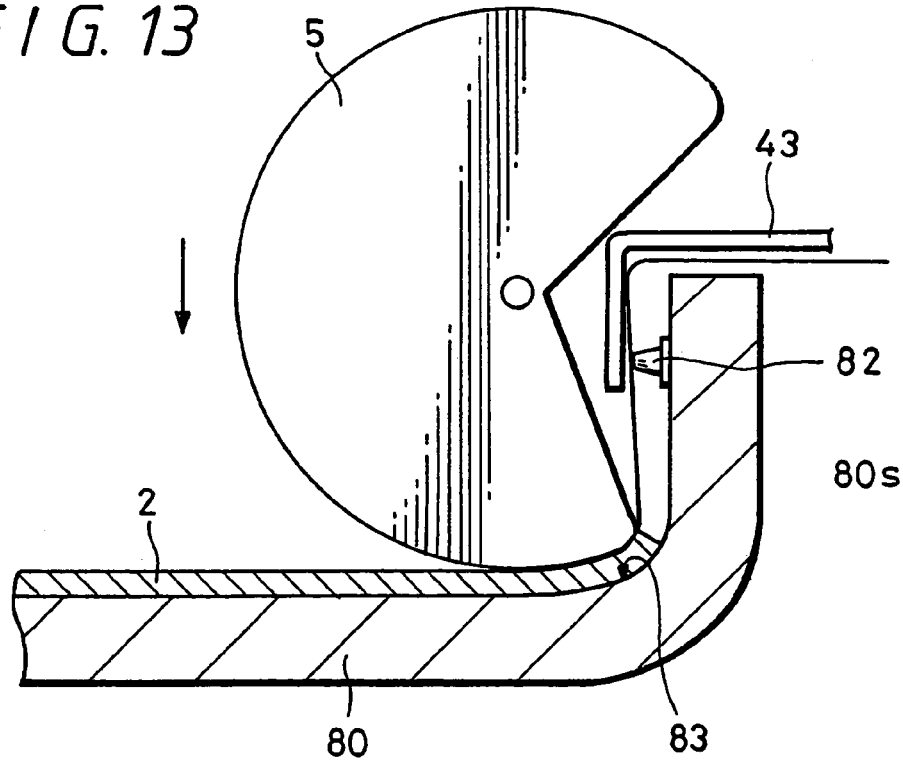
FIG. 13 is an explanatory diagram of a main portion showing an example in which a transfer roller is operating when a transfer process begins according to the present invention (No. 3)

FIGS. 11 to 13 show a method according to the first inventive example. In this method, as shown in FIG. 11, the thermal transfer roller 5 is temporarily stopped to somewhere above the inner surface of the panel so as to avoid the presser member 43 while pushing the transfer film 2 downwards. Next, as shown in FIG. 12, the moving means 7 is driven to translate the thermal transfer roller 5 in the opposite direction, i.e., in the right-hand side in the sheet of drawing and brought to the position facing the curved portion 83 of the right end edge of the panel so as to be laid beneath the panel pin 82. Next, as shown in FIG. 13, the thermal transfer roller 5 is lowered vertically to cause one end edge 16*a* of the notch portion 16 to contact with the position which is partly across the curved portion 83 of the right end edge of the panel through the transfer film 2. Then, in this state, the moving means 7 is driven to rotatably move the thermal transfer roller 5 up to the curved portion 83 of the left end edge to join the transfer film 2 to the inner surface of the panel with application of heat and pressure.

After the bonding of the transfer film 2 to the inner surface of the panel has been finished, the thermal transfer roller 5 may be operated in two ways. According to one method, the thermal transfer roller is operated in the opposite way to that required when it starts transferring the transfer film to the inner surface of the panel, i.e., after the thermal transfer roller 5 has reached the left end edge, it is a little elevated and stopped in the middle of its elevation. Then, when the thermal transfer roller 5 is moved to the right direction and released from the presser member 42, it is elevated again and returned to the standby position. According to the other method, the thermal transfer roller is operated similarly to FIGS. 9 and 10, and when the thermal transfer roller 5 is released from the presser roller 42 after it has reached the left end edge and has rotatably moved a little to the right direction, it is elevated and returned to the standby position.

According to this method in which the thermal transfer roller 5 is temporarily halted within the panel 80 and moved toward the end edge side, whereafter it is lowered to the inner surface of the panel, the thermal transfer roller 5 can reach the end edge portion of the inner surface of the panel so that the component layers of the fluorescent screen can be transferred up to the end edge of the inner surface of the panel. Moreover, since the component layers of the fluorescent screen can be transferred to the whole area of the inner surface of the panel including the end edges at the same transfer pressure, the above-mentioned imbalance of the transfer pressure can be prevented from being caused, and hence it becomes possible to uniformly transfer the component layers to the whole area of the inner surface of the panel. When the fluorescent substance layer is transferred, fogging can be prevented from being produced in the fluorescent substance layer and wrinkles can be prevented from being produced in the end edge portions and the corner portions of the fluorescent substance layer. Furthermore, since the component substance layers can be transferred up to the end edge, the effective display area can be enlarged more.

SECOND INVENTIVE EXAMPLE

The second inventive example of the present invention will be described. Specifically, in the thermal transfer roller 5, since the two end edges with respect to the axis direction have the same curved shapes (=radius of curvature $R_1$) as those of the curved portions of the upper and lower end edges of the inner surface of the panel, the end portion of the notch portion 16 has the same curved shape (=radius of curvature $R_2$) of those of the curved portion of the right and left end edges of the inner surface of the panel and the corner portion of the notch portion 16 also has the same spherical shape (=radius of curvature $R_3$) of those of the corner portions of the inner surface of the panel, the transfer film 2 can be satisfactorily joined to the curved portions around the inner surface of the panel.

Figure 14A:
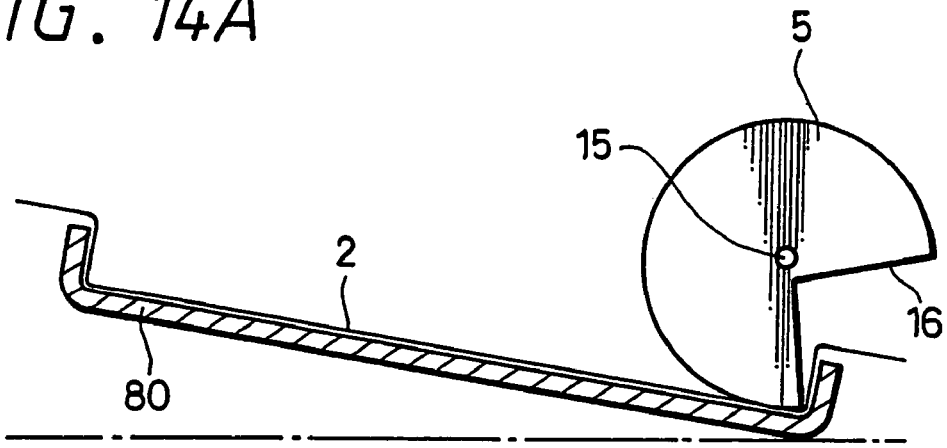
FIG. 14A is a cross-sectional view showing an example of a transfer method required when a transfer film is bonded to a curved portion of one end edge of the inner surface of the panel according to the present invention.
Figure 14B:
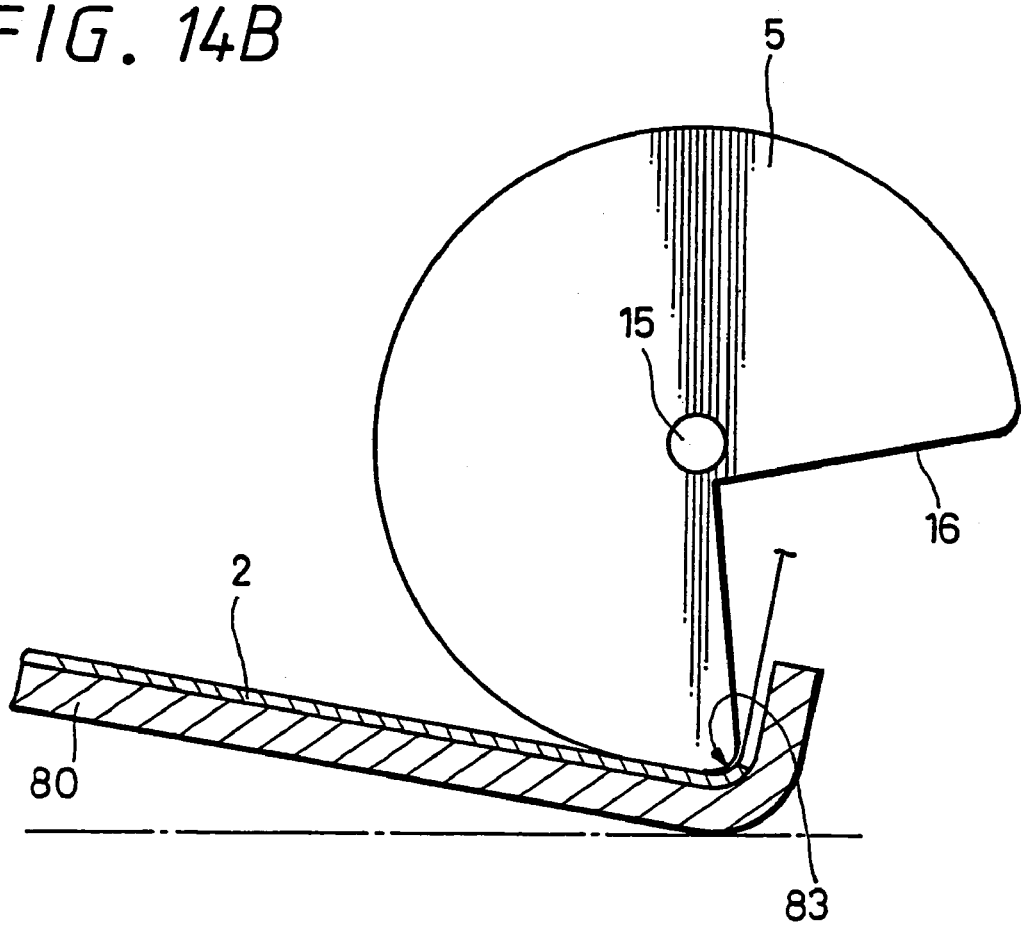
FIG. 14B is a cross-sectional view showing a main portion of FIG. 14A in an enlarge scale.
Figure 15A:
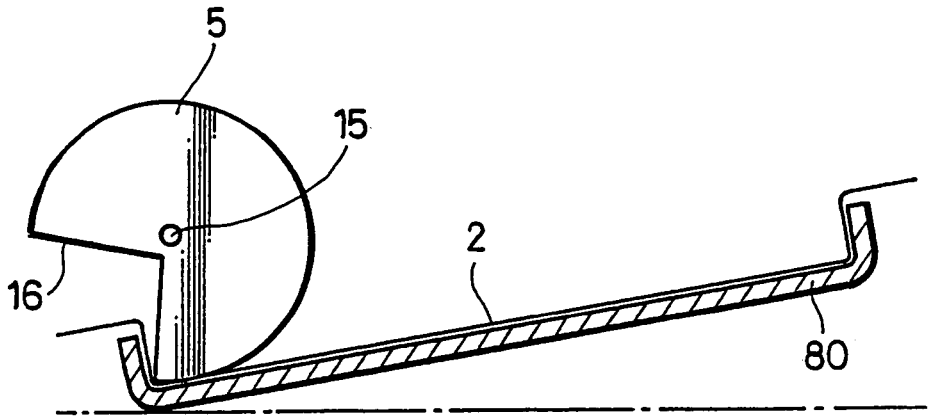
FIG. 15A is a cross-sectional view showing an example of a transfer method required when a transfer film is bonded to a curved portion of the other end edge of the inner surface of the panel according to the present invention.
Figure 15B:
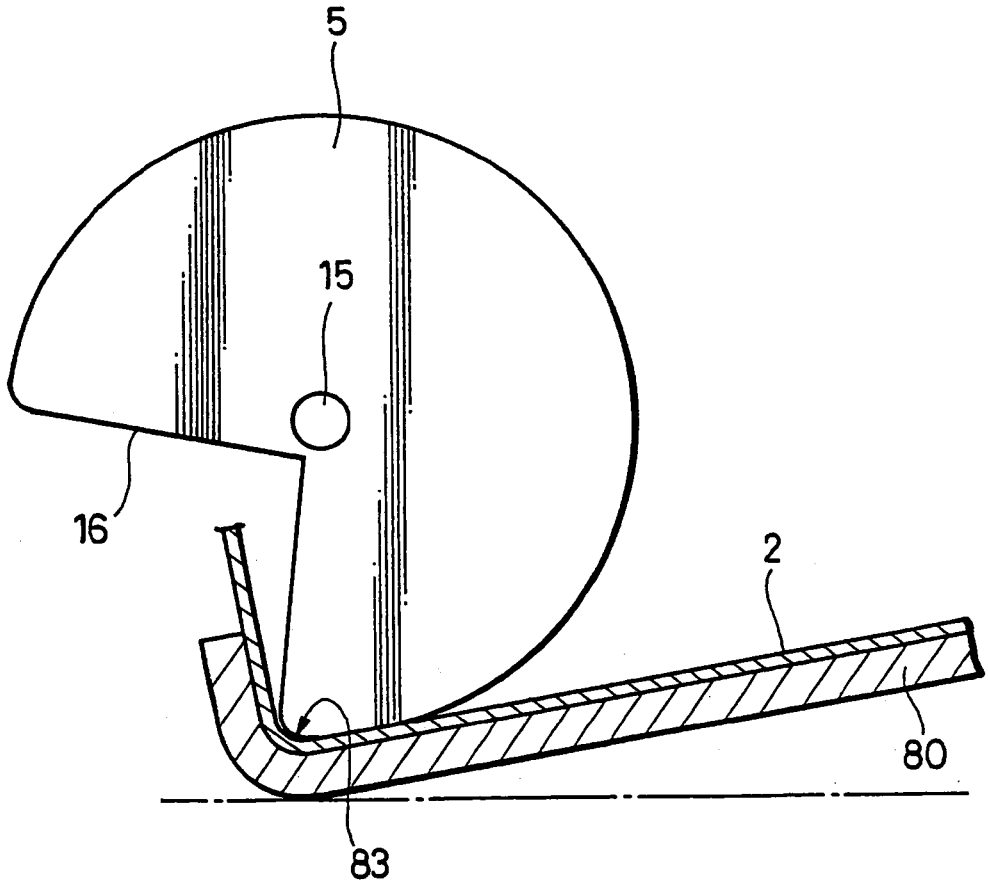
FIG. 15B is a cross-sectional view showing a main portion of FIG. 15A in an enlarged scale.

When the transfer film is joined to the curved portions 83 of the right and left end edges of the inner surface of the panel 80, the panel 80 can be selectively inclined to one or the other direction of the transfer direction and the transfer film can be joined to the inner surface of the panel. For example, as shown in FIGS. 14A, 14B (diagrams showing a main portion in an enlarged-scale), when one end edge of the transfer film 2 is bonded to the curved portions 83 of the right end edge to start the transfer, the panel 80 is inclined such that the left end side of the panel may be elevated. After the bonding of the transfer film 2 to the curved portion 83 of the right end edge has finished, the panel 80 is returned to the horizontal state, and the thermal transfer roller 5 moves toward the left end edge to join the transfer film 2 to the inner surface of the panel. When the thermal transfer roller 5 has reached the curved portion 83 of the left end edge, as shown in FIGS. 15A, 15B (diagrams showing a main portion in an enlarged-scale), the panel 80 is inclined such that its right end side is elevated and the transfer film 2 is joined to the curved portion 83 of the left end edge.

As described above, when the transfer film 2 is transferred to the curved portion 83 of the end edge of the panel, since the panel is inclined such that the panel end of the transferred side is faced downwards, the surface of the curved portion 83 is placed in substantially the horizontal state so that the transfer film can be satisfactorily joined to the inner surface of the panel by the thermal transfer roller 5.

According to this embodiment, although not shown, the fluorescent substance layer is transferred up to the end that contacts with the skirt portion 80*s* of the inner surface of the panel, and the carbon layer that serves as the light absorption layer is transferred from the end of the inner surface of the panel up to the curved portion 83 that contacts with the skirt portion 80*s*.

THIRD INVENTIVE EXAMPLE

Figure 6:
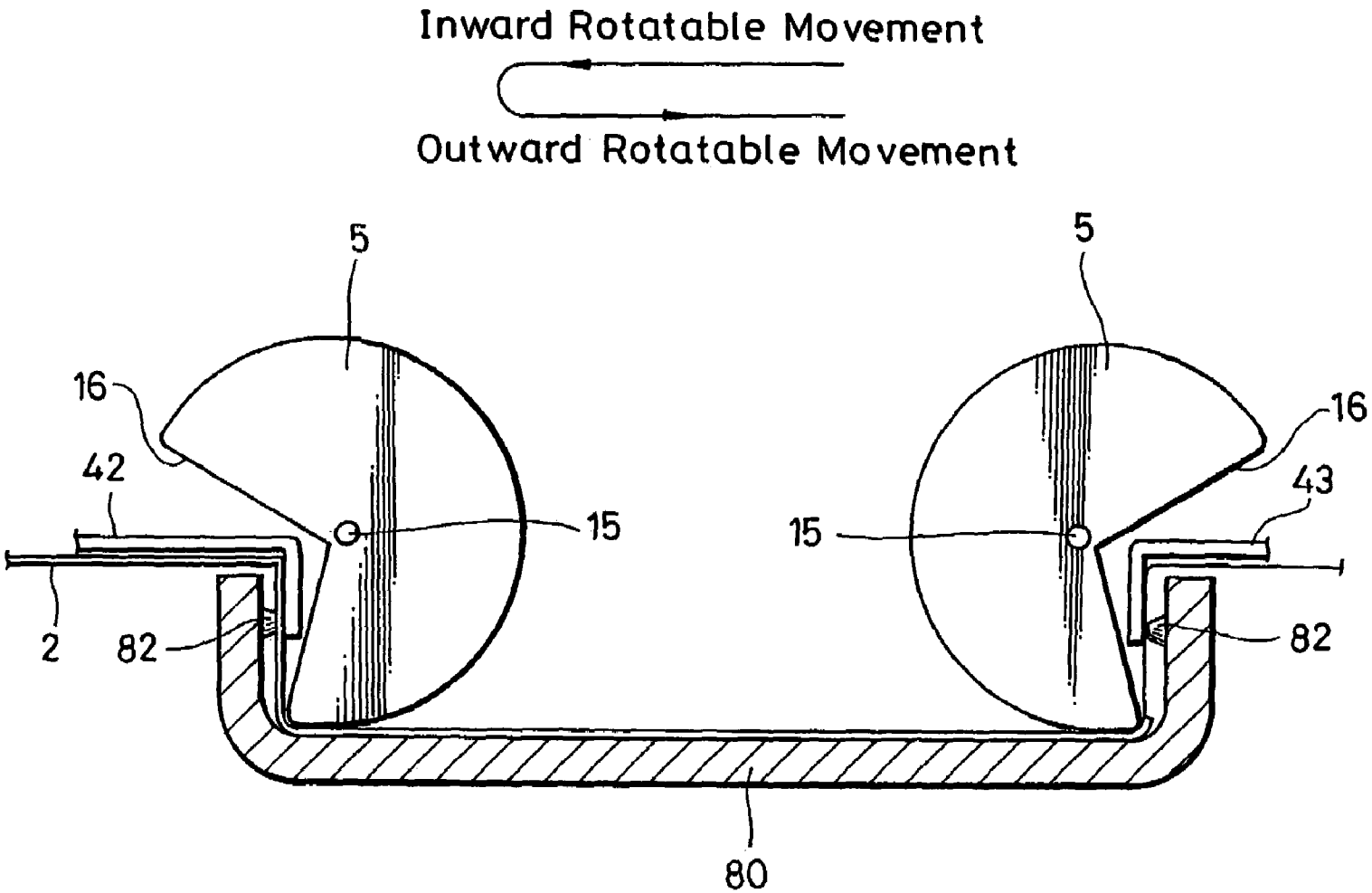
FIG. 6 is an explanatory diagram showing operations of a transfer method according to the present invention.

When the thermal transfer roller 5 is rotatably moved along the inner surface of the panel, it is preferable that the third inventive example should be applied. Specifically, as shown in FIG. 6, the thermal transfer roller 5 should preferably be rotatably moved along the inner surface of the panel 80 from one end to the other end of the transfer film or vice versa. In this inventive example, the thermal transfer roller is rotatably moved along the inner surface of the panel from one end to the other end of the transfer film or vice versa once and can be moved along the inner surface of the panel from one end to the other end of the transfer film or vice versa a plurality of times. This rotatable movement of the thermal transfer roller 5 from one end to the other end of the transfer film or vice versa may be suitably applied to the process for transferring the fluorescent substance layer after carbon stripes that are light absorption layers have been formed when the color fluorescent screen is formed. This rotatable movement of the thermal transfer roller is effective in the process for transferring the fluorescent substance layers of, in particular, colors following the second color.

FIG. 7 shows the case in which carbon stripes 51 that are light absorption layers are formed on the inner surface of the panel 80, for example, and a fluorescent substance layer stripe 52B of first color, e.g. blue (B) is formed, whereafter a transfer film 2R having a fluorescent substance layer 34R of second color, e.g. red (R) is joined to the inner surface of the panel by the thermal transfer roller 5.

Figure 7A:
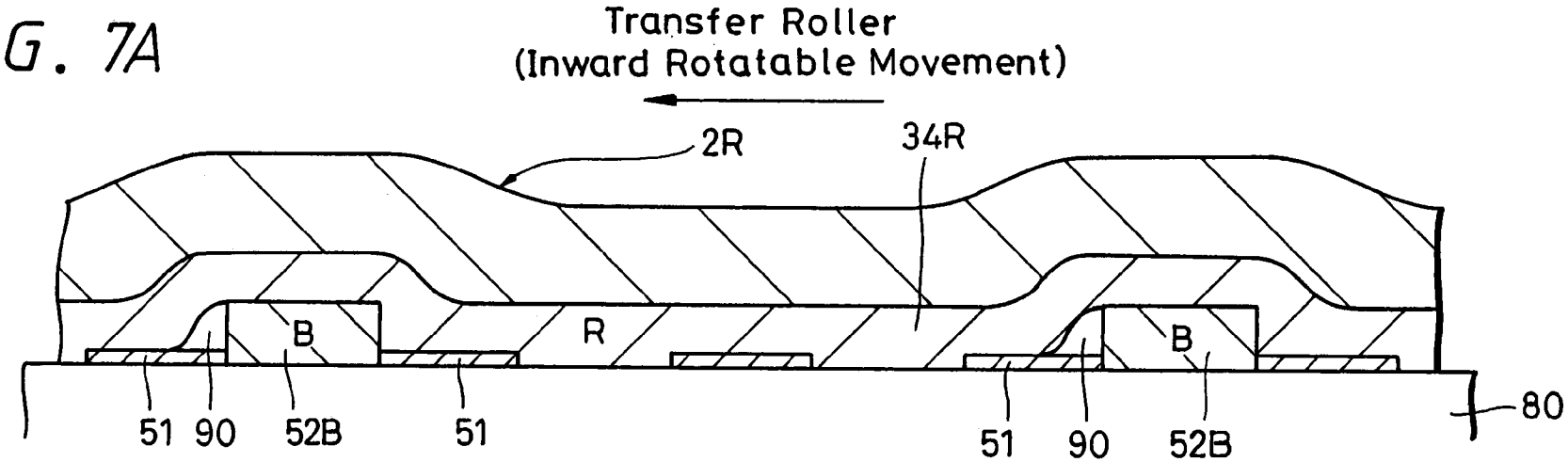
FIGS. 7A and 7B are cross-sectional views showing the state in which a transfer film is bonded according to the transfer method of FIG. 6.
Figure 7B:
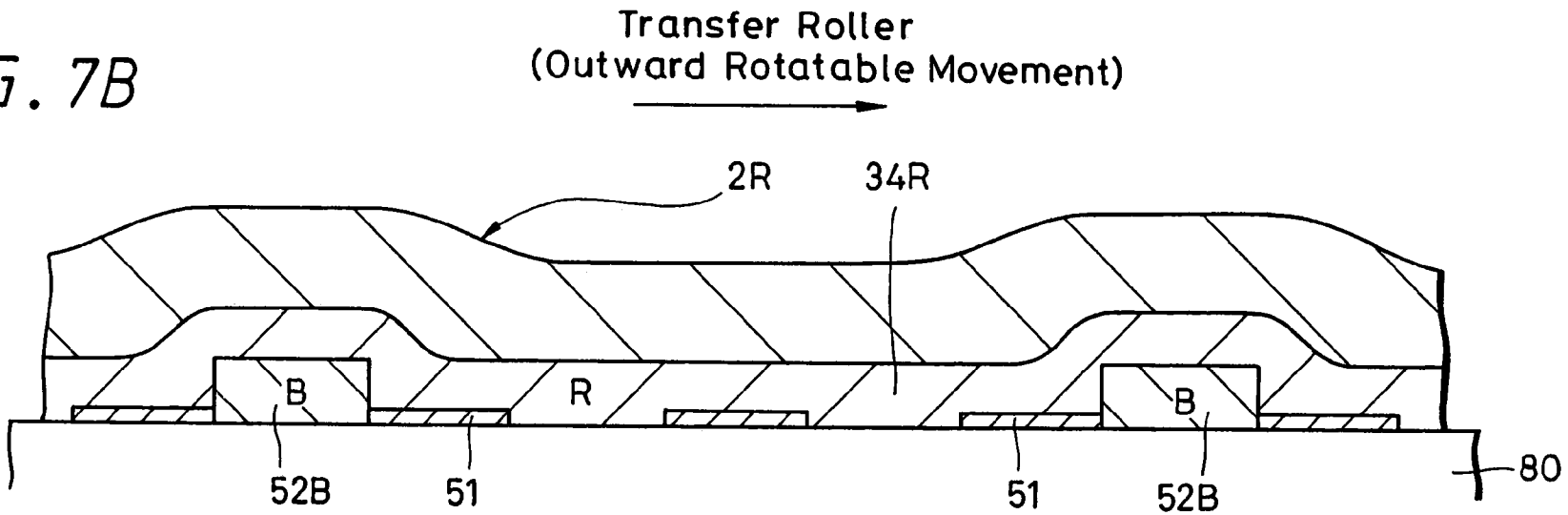

When the thermal transfer roller 5 is rotatably moved from the right-hand end edge to the left-hand end edge of the transfer film 2R, i.e., "inward rotatable movement", as shown in FIG. 7A, although the transfer film can be sufficiently bonded to the blue fluorescent substance layer stripes 52B at their stepped portions extended in the direction in which the thermal transfer roller 5 proceeds, the transfer film cannot be sufficiently bonded to the blue fluorescent substance layer stripes 52B at their hidden stepped portions and thereby gaps are produced on the inner surface of the panel. Next, as shown in FIG. 7B, when the thermal transfer roller 5 is rotatably moved from the left-hand end edge to the right-hand end edge, i.e., "outward rotatable movement", the portions of the gaps 90 which had been hidden and hence had not been bonded by the inward rotatable movement of the thermal transfer roller can be bonded to the inner surface of the panel and hence the transfer film can be uniformly joined to the whole surface of the panel.

When the thermal transfer roller 5 is rotatably moved from one end to the other end of the transfer film or vice versa over the inner surface of the panel 80, pushing force of the thermal transfer roller can be made constant during the thermal transfer roller is rotatably moved from one end to the other end of the transfer film or vice versa. Alternatively, pushing force of the thermal transfer roller can be varied during the thermal transfer roller is rotatably moved from one to the other end of the transfer film or vice versa. When the thermal transfer roller 5 is rotatably moved from one end to the other end of the transfer film or vice versa over the inner surface of the panel, moving speed of the thermal transfer roller 5 can be made constant during the thermal transfer roller is rotatably moved from one end to the other end of the transfer film or vice versa. Alternativelt, moving speed of the thermal transfer roller 5 can be varied during the thermal transfer roller is rotatably moved from one end to the other end of the transfer film or vice versa. Adhesiveness of the transfer film 2 joined to the inner surface of the panel 80 can increase as the moving speed of the thermal transfer roller 5 decreases and the pushing force of the thermal transfer roller increases. Accordingly, if the adhesive strength of the transfer film 2 is controlled by controlling the pushing force and moving speed of the thermal transfer roller 5, the transfer film can be transferred to the inner surface of the panel more preferably.

As described above, since the thermal transfer roller 5 is rotatably moved from one end to the other end of the transfer film or vice versa within the panel 80, the adhesive layer 35 of the transfer film 2 can be uniformly filled into the stripes such as the carbon stripes and the fluorescent substance stripes that had been formed so far. Hence, the transfer film can be transferred to the inner surface of the panel as it is desired and reliability of the fluorescent screen can be increased.

Next, the process for forming the color fluorescent screen together with the above-mentioned transfer processes will be described with reference to FIGS. 16 and 17.

Figure 16A:
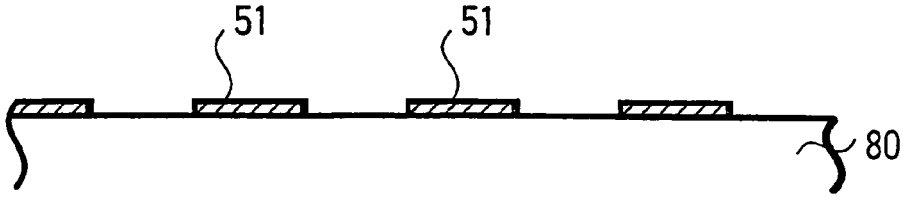
FIGS. 16A to 16E are process diagrams showing a method of forming a fluorescent screen according to an embodiment of the present invention (No. 1)

First, as shown in FIG. 16A, light absorption layers, e.g. carbon stripes are formed on the inner surface of the panel 80. The carbon stripes 51 can be formed on the inner surface of the panel by the ordinary slurry method or the above-mentioned transfer method.

Figure 16B:
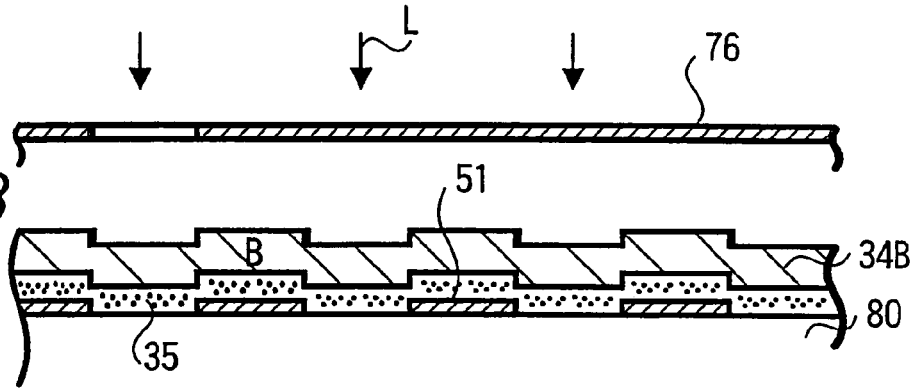

Next, as shown in FIG. 16B, a blue fluorescent substance layer 34B is transferred to the inner surface of the panel 80 by using the transfer film (similar arrangement to that of FIG. 14) including the fluorescent substance layer of first color, e.g. the blue fluorescent substance layer 34B and the adhesive layer 35 according to the transfer method. In the transfer process using the thermal transfer roller 5, the transfer film 2 is bonded to the panel with application of pressure of 1.3 kg/cm$^2$ (100 kg in real area) while the transfer film is being heated at 120° C., for example. A blue fluorescent substance layer is exposed by irradiating light (ultraviolet rays) L to this blue fluorescent substance layer 34B while the color selection structure 76 is being used as the optical mask. In this exposure treatment, the blue fluorescent substance layer 34*a* and the adhesive layer 35 are both exposed.

Figure 16C:
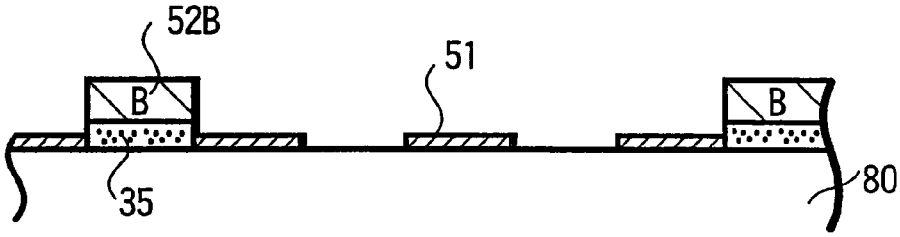

Next, as shown in FIG. 16C, the resultant product is developed by water and dried and hence the blue fluorescent substance layer stripe 52B is formed between predetermined carbon stripes.

Figure 16D:
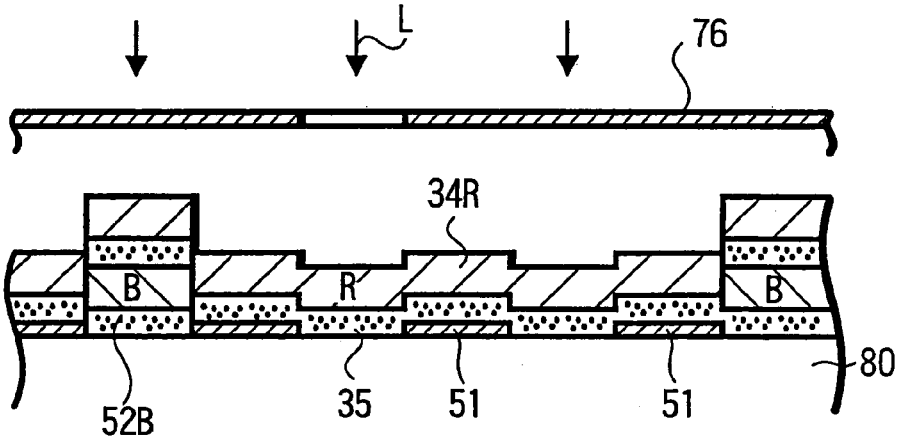

Next, as shown in FIG. 16D, the red fluorescent substance layer 34R is transferred to the inner surface of the panel 80 by using the fluorescent substance layer of second color, e.g. the red fluorescent substance layer 34R and the adhesive layer 35 according to the transfer method. Red fluorescent substance layer is exposed by irradiating light (e.g. ultraviolet rays) L to this red fluorescent substance layer 34R while the color selection structure 76 is being used as the optical mask.

Figure 16E:
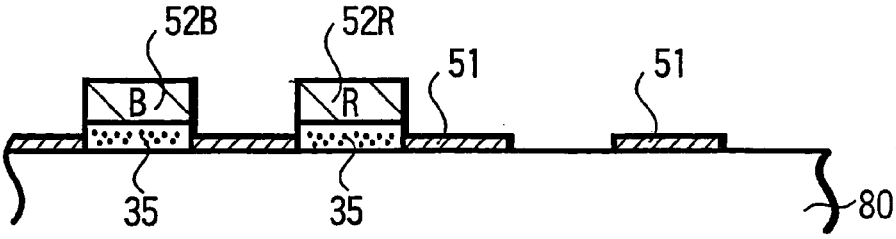

Next, as shown in FIG. 16E, the resultant product is developed by water and dried and hence a red fluorescent substance layer stripe 52R is formed between predetermined carbon stripes.

Figure 17A:
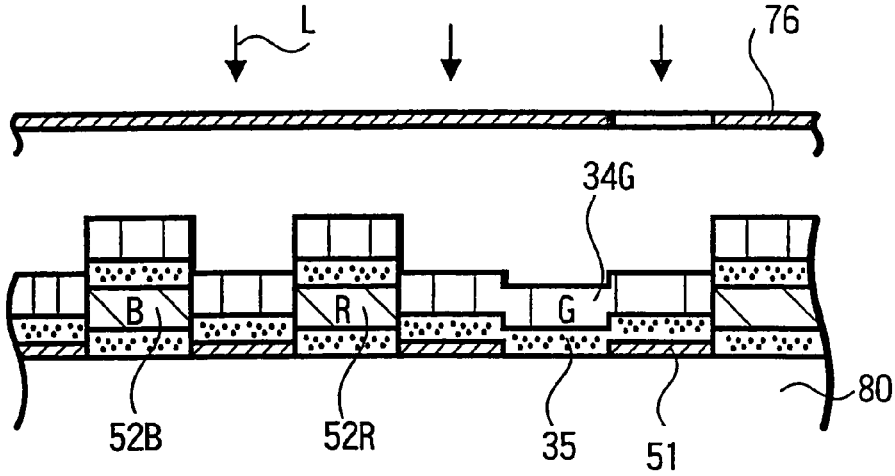
FIGS. 17A to 17C are process diagrams showing a method of forming a fluorescent screen according to an embodiment of the present invention (No. 2)

Next, as shown in FIG. 17A, the green fluorescent substance layer 34G is transferred to the inner surface of the panel 80 by using the transfer film (similar arrangement to that of FIG. 14) including the fluorescent substance layer of third color, e.g. the green fluorescent substance layer 34G and the adhesive layer 35 according to the transfer method. Green fluorescent substance layer is exposed by irradiating light (e.g. ultraviolet rays) L to this green fluorescent substance layer 34G while the color selection structure 76 is being used as the optical mask.

Figure 17B:
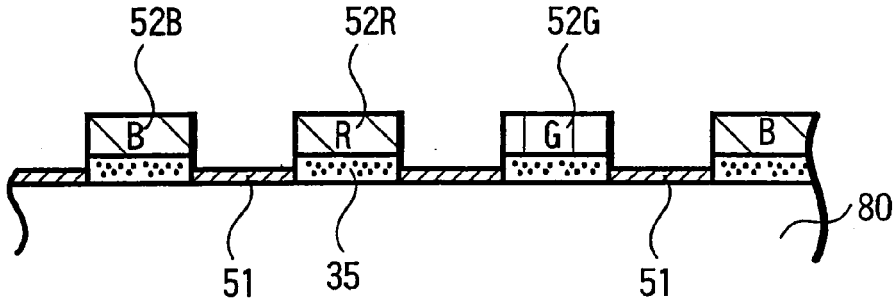

Next, as shown in FIG. 17B, the resultant product is developed by water and dried and hence a green fluorescent substance layer stripe 52G is formed between predetermined carbon stripes.

Figure 17C:
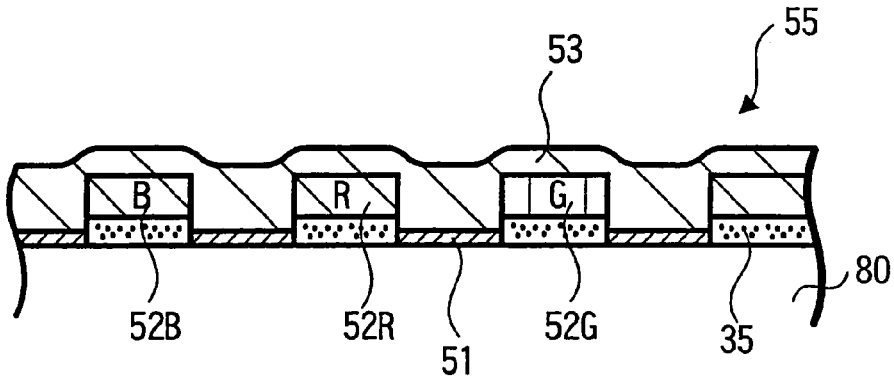

Next, as shown in FIG. 17C, an intermediate film, not shown, is coated and a metal-back layer 53 made of a suitable material such as aluminum (Al) is formed on the whole surface. If a transfer film including at least an Al layer and adhesive layers is in use, then the metal-back layer 53 can be formed by a transfer process. In this manner, a desired color fluorescent screen 55 can be formed. With the transfer method according to this embodiment, it becomes possible to form a highly-reliable fluorescent screen having a large effective display area.

Figure 20:
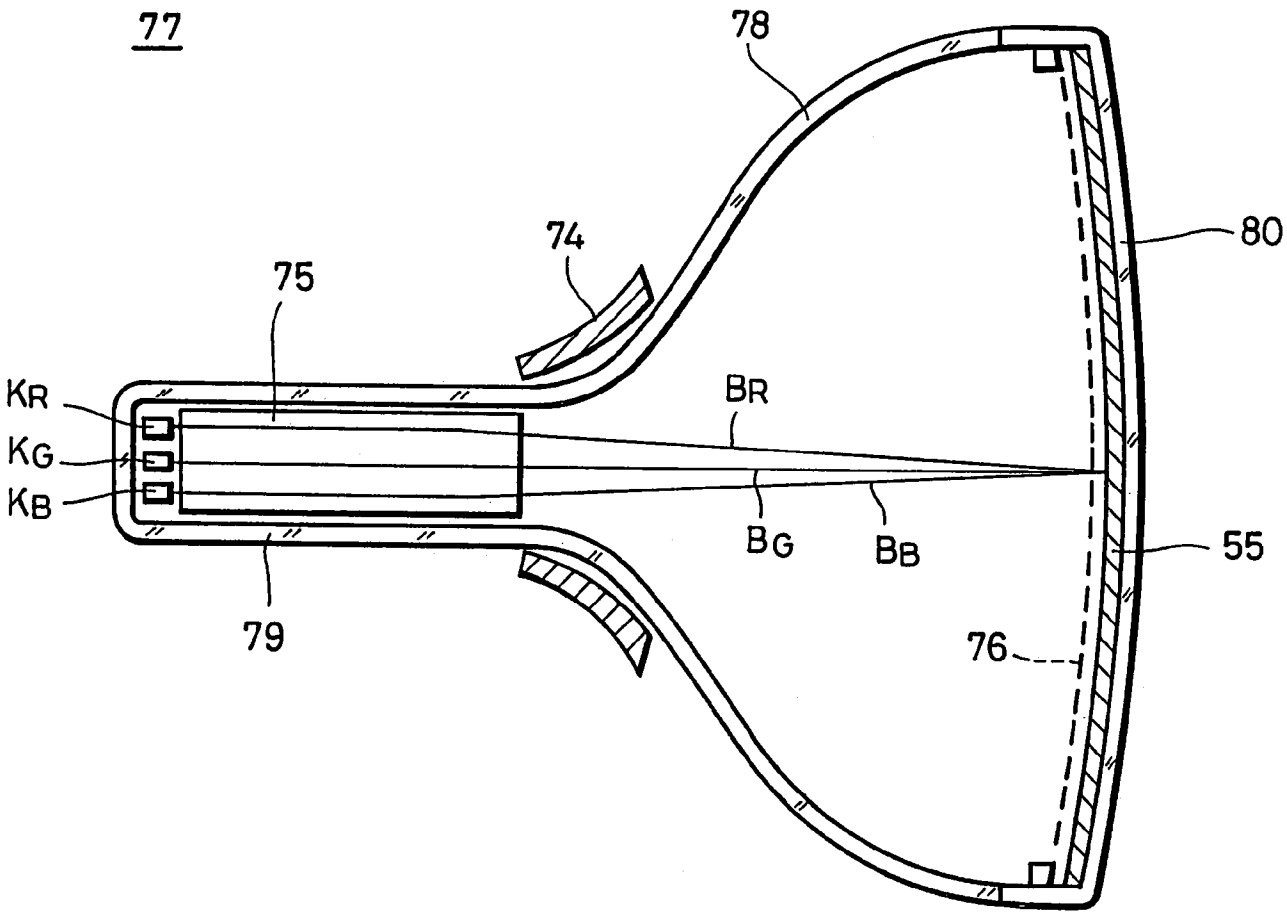
FIG. 20 is a diagram showing a cathode-ray tube according to an embodiment of the present invention.

FIG. 20 shows a color cathode-ray tube according to an embodiment of the present invention.

A color cathode-ray tube 77 according to the present invention has a cathode-ray tube assembly (glass cathode-ray tube assembly) 78 in which the color fluorescent screen 55 composed of fluorescent substance layers of respective colors of red (R), green (G), blue (B) is formed on the inner surface of the panel 78 by the above-mentioned fluorescent screen forming method of the present invention. A color selection structure 76 is opposed to this color fluorescent screen 55, and an electron gun 75 of in-line type, for example, is disposed within a neck portion 79. A deflection yoke 74 for deflecting electron beams $B_R$, $B_G$ and $B_B$ from the electron gun 75 in the horizontal and vertical directions is disposed at the outside of the cathode-ray tube assembly.

In this color cathode-ray tube 77, electron beams B [$B_R$, $B_G$, $B_B$] corresponding to the respective colors and which are emitted from cathodes K [$K_R$, $K_G$, $K_B$] corresponding to red (R), green (G), blue (B) of an electron gun 83 are converged by a main electron lens composed of a plurality of grid electrodes, focused and converged on the fluorescent screen 55 and thereby irradiated on the respective red, green and blue fluorescent substance layers. The electron beams $B_R$, $B_G$, $B_B$ are deflected by the deflection yoke 74 in the horizontal and vertical directions and thereby a desired color image is displayed.

Since the color cathode-ray tube according to this embodiment includes the fluorescent screen 55 formed by the above-mentioned transfer method of the present invention, it is possible to provide a color cathode-ray tube in which the fluorescent screen 55 can be made highly-reliable, an effective display area thereof can be enlarged and which can display an image on a larger screen.

As described above, according to this embodiment, when the transfer film is transferred onto the panel by the transfer roller, if the transfer roller is moved from one end to the other end of the transfer film or vice versa over the panel once, then the speed of the transfer roller can be increased, the transfer process can be made more efficient and, accordingly, work efficiency can be increased. If the transfer roller is moved from one end to the other end of the transfer film or vice versa over the panel a plurality of times, then the adhesive layers of the transfer film can be uniformly filled into the adjacent light absorption layers or adjacent fluorescent substance layers so that the transfer film can be uniformly transferred onto the panel, thereby making it possible to form the highly-reliable fluorescent screen. In particular, when the component layers of the transfer film are the fluorescent substance layers corresponding to the respective colors, the present invention is effective in transferring the transfer films of second color and the following color. The fluorescent screen can be formed inexpensively.

If the transfer roller is moved from one end to the other end of the transfer film over the inner surface of the panel at least once, the transfer speed can be increased and hence the transfer can be made more efficient. The adhesive layers of the transfer film can be uniformly joined to the whole surface, and a reliability of the transfer can be increased. Since the fluorescent screen is formed by using the transfer method, it becomes possible to form a highly-reliable fluorescent screen at a low cost as compared with the slurry method.

When the transfer film is transferred onto the inner surface of the panel by the transfer roller, if the transfer roller that is lowered in unison with the transfer film is temporarily halted within the panel, moved toward the end edge side and lowered to the inner surface of the panel to start pressing the transfer film, then the component layers of the fluorescent screen can be satisfactorily transferred up to the end edges including the corner portions of the inner surface of the panel, and hence the effective display area can be enlarged by the transfer process. Since the transfer roller starts pressing the transfer film from the end edge of the inner surface of the panel and the transfer film is transferred to the whole surface of the inner surface of the panel at the same transfer pressure, fogging can be prevented from being produced in the fluorescent substance layer and wrinkles can be prevented from being produced in the fluorescent substance layers of the corner portions so that the highly-reliable fluorescent screen can be formed. The transfer process can be made more efficient and, accordingly, work efficiency can be increased.

If the panel 80 is inclined when the transfer film 2 is jointed to the end edge portions including the corner portions of the inner surface of the panel, the transfer film can be joined to the curved portions of the end edges without wrinkles being produced, and hence the highly-reliable fluorescent screen can be formed. If the thermal transfer roller whose portions corresponding to the peripheral portion and the corner portions of the inner surface of the panel are shaped like the same curved shapes as those of the curved portions, when the transfer film 2 is joined to the end edge portions including the corner portions of the inner surface of the panel, the transfer film can be bonded to the curved portions of the end edges without wrinkles being produced, and hence the highly-reliable fluorescent screen can be formed. In particular, these advantages are coupled with each other, and hence the fluorescent screen which is high in reliability and which has the large effective display area can be formed. The transfer process can be made more efficient, and accordingly, work efficiency can be increased.

When the cathode-ray tube includes the fluorescent screen formed by the above-described transfer method, it is possible to provide a highly-reliable cathode-ray tube having the large effective display area. The cathode-ray tube can be manufactured inexpensively.

The above-mentioned transfer method of the present invention can be applied to the transfer process of all components comprising the fluorescent screen. Accordingly, as the transfer film 2, there can be used a transfer film in which component layers serving as components of the fluorescent screen are formed of so-called full-color fluorescent substance layers including single fluorescent substance layer corresponding to each color and respective color fluorescent substance layers (e.g. fluorescent substance layer stripes) of red, green and blue and the like, the light absorption layer (e.g. carbon layer) or metal layer such as aluminum serving as the metal-back layer.

While the fluorescent screen forming method of the present invention is applied to the manufacturing process of the fluorescent screen of the color cathode-ray tube, the present invention can also be applied to other display apparatus such as a single-color cathode-ray tube for use in projectors, a PDP (plasma display panel), an LCD (liquid-crystal display), an FED (field-emission display) and all sorts of display devices using other fluorescent substances.

The invention claimed is:

1. A fluorescent screen forming method of bonding a transfer film composed of at least adhesive layers and component layers serving as components of a fluorescent screen to a panel up to the end edge of said panel by a transfer roller to form a fluorescent screen on said panel, comprising the steps of lowering said transfer film to somewhere above the inner surface of the panel by a transfer roller so as to avoid panel pins formed on said panel, moving a pressing start end portion of said transfer roller to the position corresponding to the end edge of the inner surface of said panel and lowering said transfer roller in unison with said transfer film onto the end edge of the inner surface of said panel to start pressing said transfer film.

2. A fluorescent screen forming method according to claim 1, wherein said component layers are fluorescent substance layers corresponding to respective colors, fluorescent substance layers having respective colors formed as one body, light absorption layers or metal-back layers.

3. A fluorescent screen forming method of bonding a transfer film composed of at least adhesive layers and component layers serving as components of a fluorescent screen to a panel up to the end edge of said panel to form a fluorescent screen on a panel, comprising the steps of overlaying said transfer film on said panel and pressing said transfer filmy a transfer roller in which portions corresponding to peripheral portions and curved portions of corner portions of the inner surface of said panel are formed as the same curved portions as those of the curved portions while said panel is being inclined such that the end edge of the pressed side is faced downwards when said transfer film is pressed against the end edge portion of the inner surface of the panel.

4. A fluorescent screen forming method according to claim 3, wherein said component layers of said transfer film are fluorescent substance layers corresponding to respective colors, fluorescent substance layers having respective colors formed as one body, light absorption layers or metal-back layers.

5. A fluorescent screen forming apparatus for bonding a transfer film to a panel up to the end edge of said panel to form a fluorescent screen on a panel, comprising supply means for supplying a transfer film composed of at least adhesive layers and component layers serving as components of a fluorescent screen, a transfer roller for rotatably moving said transfer film overlaid on said panel while heating and pressing said transfer film, inclining means for selectively inclining said panel held on a holder to one or the other transfer direction and control means for controlling said supply means, said transfer roller and said inclining means, wherein said transfer roller is formed as the same curved shapes as those of curved portions at its portions corresponding to peripheral portion and curved portions of corner portion of the inner surface of the panel.

* * * * *